US010082330B2

(12) United States Patent
Chung et al.

(10) Patent No.: US 10,082,330 B2
(45) Date of Patent: Sep. 25, 2018

(54) REFRIGERATOR AND METHOD FOR CONTROLLING A REFRIGERATOR

(71) Applicant: LG ELECTRONICS INC., Seoul (KR)

(72) Inventors: Myungjin Chung, Seoul (KR); Yonghun Suh, Seoul (KR); Sung Jhee, Seoul (KR); Namsoo Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 144 days.

(21) Appl. No.: 15/074,105

(22) Filed: Mar. 18, 2016

(65) Prior Publication Data

US 2016/0313054 A1 Oct. 27, 2016

(30) Foreign Application Priority Data

Apr. 21, 2015 (KR) ..... 10-2015-0055735

(51) Int. Cl.
*F25B 5/00* (2006.01)
*F25D 29/00* (2006.01)
(Continued)

(52) U.S. Cl.
CPC ..... *F25D 29/00* (2013.01); *F25D 11/022* (2013.01); *F25D 17/065* (2013.01);
(Continued)

(58) Field of Classification Search
CPC ..... F25D 29/00; F25D 17/065; F25D 11/022; F25D 2600/06; F25D 2600/04; F25D 2700/14; F25D 2700/12
See application file for complete search history.

(56) References Cited

U.S. PATENT DOCUMENTS 6,397,608 B1 * 6/2002 Sakuma ..... F25B 5/02 62/158
2003/0131618 A1 7/2003 Doi et al.
(Continued)

FOREIGN PATENT DOCUMENTS

CN 104344587 2/2015
EP 1707900 10/2006
(Continued)

OTHER PUBLICATIONS

Taniguchi et al., Refrigerator, Apr. 21, 2011, JP2011080696A, Whole Document.*
(Continued)

*Primary Examiner* — Larry Furdge
(74) *Attorney, Agent, or Firm* — KED & Associates LLP

(57) ABSTRACT

A refrigerator and a method for controlling a refrigerator, including a plurality of compressors and a plurality of evaporators disposed on inlet-sides of the plurality of compressors to supply cool air to a refrigerating compartment and a freezing compartment includes determining whether a temperature of the refrigerating compartment belongs to a refrigerating compartment satisfaction range, determining an indoor temperature when the temperature of the refrigerating compartment does not belong to the refrigerating compartment satisfaction range, and determining whether a load corresponding operation condition is satisfied when the determined indoor temperature belongs to a set range. When the load corresponding operation condition is satisfied, a simultaneous operation of the refrigerating compartment and the freezing compartment is performed, and when the load corresponding operation condition is not satisfied, a cooling operation of the refrigerating compartment is performed.

15 Claims, 12 Drawing Sheets

(51) Int. Cl.
*F25D 11/02* (2006.01)
*F25D 17/06* (2006.01)

(52) U.S. Cl.
CPC ..... *F25D 2600/04* (2013.01); *F25D 2600/06* (2013.01); *F25D 2700/12* (2013.01); *F25D 2700/14* (2013.01)

(56) References Cited

U.S. PATENT DOCUMENTS

| | | | | |
|---|---|---|---|---|
| 2012/0023978 | A1* | 2/2012 | Chae | F25B 1/10 62/115 |
| 2012/0023980 | A1 | 2/2012 | Lee et al. | |
| 2013/0186129 | A1* | 7/2013 | Bae | F25D 11/00 62/498 |

FOREIGN PATENT DOCUMENTS

| | | | |
|---|---|---|---|
| EP | 2869004 | | 5/2015 |
| JP | 2011080696 | | 4/2011 |
| JP | 2011080696 | A * | 4/2011 |
| JP | 2015010815 | | 1/2015 |
| KR | 10-2002-0092633 | | 12/2002 |
| KR | 2008-0088848 | | 10/2008 |
| KR | 10-2012-0011656 | | 2/2012 |
| KR | 2015-0017183 | | 2/2015 |
| WO | WO 2008/120864 | | 10/2008 |

OTHER PUBLICATIONS

European Search Report dated Sep. 19, 2016 issued in Application No. 16162213.9.
Korean Office Action dated Oct. 14, 2016 issued in Application No. 10-2015-0055735.
European Search Report dated Feb. 27, 2017 issued in Application No. EP 16 16 2213.9.
Chinese Office Action dated Mar. 19, 2018 issued in Application No. 201610213106.9 (with English translation).

* cited by examiner

REFRIGERATOR AND METHOD FOR CONTROLLING A REFRIGERATOR

CROSS-REFERENCE TO RELATED APPLICATION(S)

The present application claims priority under 35 U.S.C. 119 and 35 U.S.C. 365 to Korean Patent Application No. 10-2015-0055735 (filed on Apr. 21, 2015), which is hereby incorporated by reference in its entirety.

BACKGROUND

1. Field

The present disclosure relates to a refrigerator and a method for controlling a refrigerator.

2. Background

A refrigerator may have a plurality of storage compartments to store foods in a frozen or refrigerated state. Each of the storage compartments may have one surface that is opened to receive or dispense the foods. The plurality of storage compartments may include a freezing compartment for storing foods in a frozen state and a refrigerating compartment for storing foods in a refrigerated state.

A refrigeration system in which a refrigerant is circulated may be driven in the refrigerator. The refrigeration system may include a compressor, a condenser, an expansion device, and an evaporator. The evaporator may include a first evaporator provided at a side of the refrigerating compartment and a second evaporator provided at a side of the freezing compartment.

Cool air stored in the refrigerating compartment may be cooled while passing through the first evaporator, and the cool air may be supplied again into the refrigerating compartment. Also, the cool air stored in the freezing compartment may be cooled while passing through the second evaporator, and the cool air may be supplied again into the freezing compartment. Independent cooling may be performed in the plurality of storage compartments through separate evaporators.

A refrigerator as described above has been registered as Korean Patent Registration No. 10-1275184 (Registration Date: Jun. 10, 2013), whose entire disclosure is hereby incorporated by reference. In the refrigerator, the refrigerant may be selectively supplied into the first or second evaporator by controlling a refrigerant supply unit (or a refrigerator supply tank) to cool a first storage compartment of the plurality of storage compartments and stop cooling of a second storage compartment. The first storage compartment and the second storage compartment may be selectively or alternately cooled. Although the storage compartment in which the cooling is performed may be maintained to an adequate temperature, the storage compartment in which the cooling is not performed may be increased in temperature and thus be out of a normal temperature range.

In a state where the cooling of the first storage compartment is required, if it is determined that the second storage compartment gets out of the normal temperature range, the second storage compartment may not be immediately cooled. As a result, in the structure in which the storage compartments are independently cooled, the cool air may not be supplied at a suitable time and place, which may deteriorate an operation efficiency of the refrigerator.

If both outlet sides of the refrigerant supply unit are opened to cool the plurality of storage compartments at the same time, the refrigerant may be concentrated into one evaporator of the plurality of evaporators. Particularly, when the three-way valve is used as the refrigerant supply unit, it may be difficult to maintain physical equilibrium in the three-way valve. As a result, a relatively large amount of refrigerant may be introduced into one evaporator, and a relatively small amount of refrigerant may be introduced into the other evaporator.

BRIEF DESCRIPTION OF THE DRAWINGS

The embodiments will be described in detail with reference to the following drawings in which like reference numerals refer to like elements wherein.

DETAILED DESCRIPTION

Figure 1:
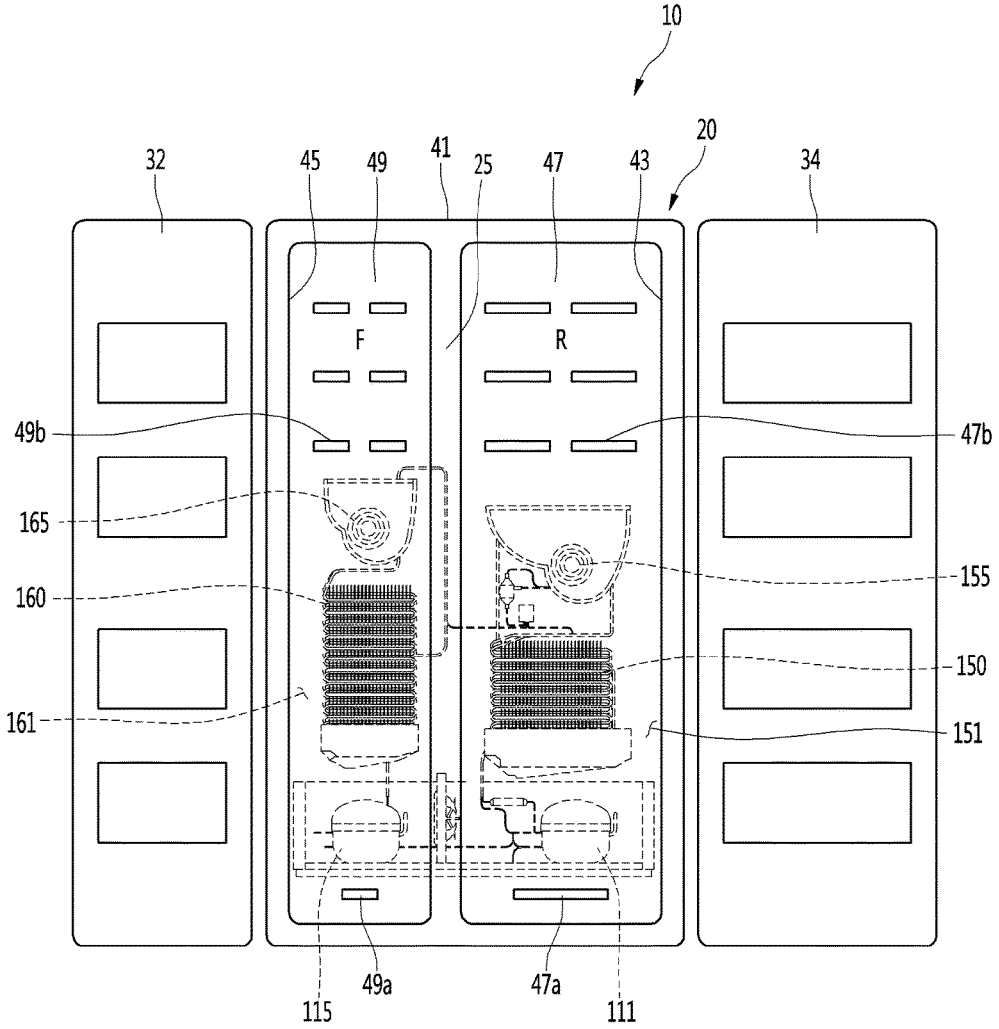
FIG. 1 is a view of a refrigerator according to an embodiment.

Referring to FIG. 1, a refrigerator 10 according to an embodiment may include a cabinet 20 having a freezing compartment F and a refrigerating compartment R. The refrigerating compartment R and the freezing compartment F may be partitioned by a partition wall 25. Although the freezing compartment F and the refrigerating compartment R are horizontally spaced apart from each other FIG. 1, the present disclosure is not limited thereto. For example, the freezing compartment F and the refrigerating compartment R may be vertically spaced apart from each other.

The cabinet 20 may include a freezing compartment door 32 for opening and closing the freezing compartment F and a refrigerating compartment door 34 for opening and closing the refrigerating compartment R. The cabinet 20 may include an outer case 41 defining an outer appearance of the refrigerator 10, a freezing compartment inner case 45 provided inside the outer case 41 to define an inner surface of the freezing compartment F, and a refrigerating compartment inner case 43 provided inside the outer case 41 to define an inner surface of the refrigerating compartment R.

The refrigerator 10 may include a plurality of evaporators 150 and 160 for independently cooling the refrigerating compartment R and the freezing compartment F. The plurality of evaporators 150 and 160 may include a first evaporator 150 for cooling the refrigerating compartment R and a second evaporator 160 for cooling the freezing compartment F. The first evaporator 150 may be called a "refrigerating compartment evaporator", and the second evaporator 160 may be called a "freezing compartment evaporator".

The cabinet 20 may include a freezing compartment rear panel 49 that partitions an inner space of the freezing compartment inner case 45 into the freezing compartment F to store foods in a frozen state and a freezing heat-exchange chamber 161 in which the freezing compartment evaporator 160 may be accommodated. The freezing compartment rear panel 49 may be understood as a "freezing compartment cover" that functions as a storage compartment cover to cover the freezing heat-exchange chamber 161 against the freezing compartment F, and the freezing heat-exchange chamber 161 may be defined at a rear side of the freezing compartment rear panel 49.

A cool air suction hole 49*a* through which the cool air of the freezing compartment F may be introduced into the freezing heat-exchange chamber 161 and a cool air discharge hole 49*b* through which the cool air cooled by the freezing compartment evaporator 160 may be discharged into the freezing compartment F may be located in the freezing compartment rear panel 49. The cool air suction hole 49*a* may be defined in a lower portion of the freezing compartment F, and the cool air discharge hole 49*b* may be provided in plurality and located in the upper portion of the freezing compartment F. A freezing compartment fan 165 that may function as a "blower fan" to circulate air of the freezing compartment F into the freezing heat-exchange chamber 161 and the freezing heat-exchange chamber 161 may be provided in the freezing compartment F.

The cabinet 20 may include a refrigerating compartment rear panel 47 that partitions an inner space of the refrigerating compartment inner case 43 into the refrigerating compartment R to store foods in a refrigerated state and a refrigerating heat-exchange chamber 151 in which the refrigerating compartment evaporator 150 is accommodated. The refrigerating compartment rear panel 47 may be understood as a "refrigerating compartment cover" that functions as a storage compartment cover to cover the refrigerating heat-exchange chamber 151 against the refrigerating compartment R, and the refrigerating heat-exchange chamber 151 may be defined at a rear side of the refrigerating compartment rear panel 47.

A cool air suction hole 47*a* through which the cool air of the refrigerating compartment R may be introduced into the refrigerating heat-exchange chamber 151 and a cool air discharge hole 47*b* through which the cool air cooled by the refrigerating compartment evaporator 150 may be discharged into the refrigerating compartment R may be defined in the refrigerating compartment rear panel 47. The cool air suction hole 47*a* may be located in a lower portion of the refrigerating compartment R, and the cool air discharge hole 47*b* may be provided in plurality and located in the upper portion of the refrigerating compartment R. A refrigerating compartment fan 155 that may function as a "blower fan" to circulate air of the refrigerating compartment R into the refrigerating heat-exchange chamber 151 and the refrigerating compartment R may be provided in the refrigerating heat-exchange chamber 151.

The refrigerating compartment rear panel 47 and the freezing compartment rear panel 49 may be provided on both sides of the partition wall 25. Also, the refrigerating heat-exchange chamber 151 and the freezing heat-exchange chamber 161 may be commonly called a "heat-exchange chamber".

Figure 2:
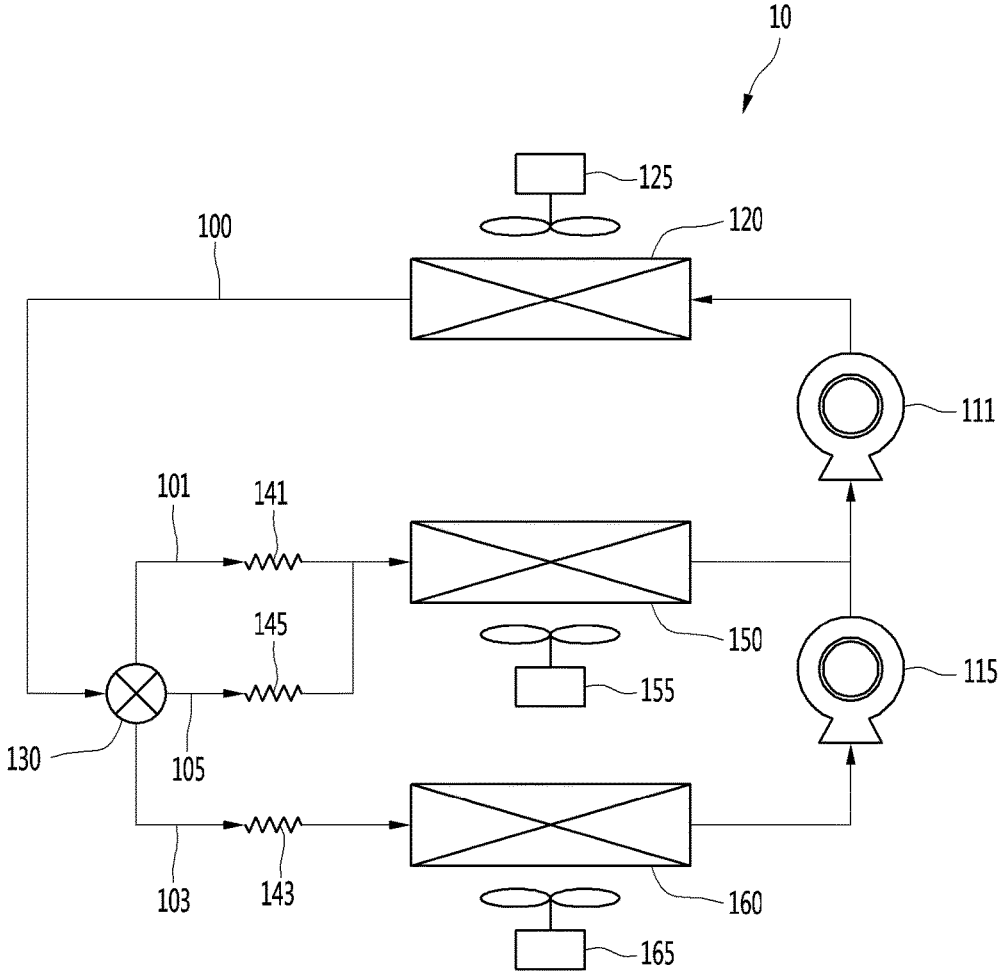
FIG. 2 is a view of a system having a refrigeration cycle in the refrigerator according to an embodiment.

Referring to FIG. 2, the refrigerator 10 according to the current embodiment may include a plurality of devices to drive a refrigeration cycle. The refrigerator 10 may include a plurality of compressors 111 and 115 that compress a refrigerant, a condenser 120 that condenses the refrigerant compressed in the plurality of compressors 111 and 115, a plurality of expansion devices 141, 143, and 145 that decompress the refrigerant condensed in the condenser 120, and a plurality of evaporators 150 and 160 that evaporates the refrigerant decompressed in the plurality of expansion devices 141, 143, and 145. The refrigerator 10 may also include a refrigerant tube 100 connecting the plurality of compressors 111 and 115, the condenser 120, the expansion devices 141, 143, and 145, and the evaporators 150 and 160 to each other to guide a flow of the refrigerant.

The plurality of compressors 111 and 115 may include a second compressor 115 provided at a low-pressure side and a first compressor 111 that may further compresses the refrigerant compressed in the second compressor 115. The first compressor 111 and the second compressor 115 may be connected to each other in series such that an outlet-side refrigerant tube of the second compressor 115 may be connected to an inlet-side of the first compressor 111.

When an exclusive cooling operation of the refrigerating compartment R of the refrigerator is performed, the driving of the second compressor 115 may be stopped, and only the first compressor 111 may be driven. When either an exclusive cooling operation of the freezing compartment F or the simultaneous operation of the refrigerating compartment R and the freezing compartment F are performed, both the first and second compressors 111 and 115 may be driven.

The plurality of evaporators 150 and 160 may include a first evaporator 150 that generates cool air to be supplied into the refrigerating compartment R and a second evaporator 160 that generates cool air to be supplied into the freezing compartment F. The cool air to be supplied into the freezing compartment may have a temperature lower than a temperature of the cool air to be supplied into the refrigerating compartment. Thus, a refrigerant evaporation pressure of the second evaporator 160 may be less than a refrigerant evaporation pressure of the first evaporator 150.

An outlet-side refrigerant tube 100 of the second evaporator 160 may extend to an inlet-side of the second compressor 115. The refrigerant passing through the second evaporator 160 may then be suctioned into the second compressor 115. The outlet-side refrigerant tube 100 of the first evaporator 150 may be connected to the outlet-side refrigerant tube of the second compressor 115. The refrigerant passing through the first evaporator 150 may then be mixed with the refrigerant compressed in the second compressor 115, and the mixture may then be suctioned into the first compressor 111.

The plurality of expansion devices 141, 143, and 145 include first and third expansion devices 141 and 145 that expand the refrigerant to be introduced into the first evaporator 150 and a second expansion device 143 that expands the refrigerant to be introduced into the second evaporator 160. Each of the first to third expansion devices 141, 143, and 145 may include a capillary tube. The capillary tube of the second expansion device 143 may have a diameter less than that of the capillary tube of each of the first and third expansion devices 141 and 145 so that a refrigerant evaporation pressure of the second evaporator 160 is less than a refrigerant evaporation pressure of the first evaporator 150.

A plurality of refrigerant passages 101 and 105 that guide the introduction of the refrigerant into the first evaporator 150 may be defined at or in the inlet-side of the first evaporator 150. The plurality of refrigerant passages 101 and 105 may include a first refrigerant passage 101 in which the first expansion device 141 may be provided and a third refrigerant passage 105 in which the third expansion device 145 may be provided. The first and third refrigerant passages 101 and 105 may be collectively referred to as a "first evaporation passage" in that the first and third refrigerant passages 101 and 105 guide the introduction of the refrigerant into the first evaporator 150. The refrigerants flowing into the first and third refrigerant passages 101 and 105 may be mixed with each other and then be introduced into the first evaporator 150.

One refrigerant passage 103 for guiding the introduction of the refrigerant into the second evaporator 160 may be defined at or in an inlet-side of the second evaporator 160. The refrigerant passage 103 may include the second refrigerant passage 103 in which the second expansion device 143 may be provided. The second refrigerant passage 103 may be referred to as a "second evaporation passage" in that the second refrigerant passage 103 guides the introduction of the refrigerant into the second evaporator 160. The first to third refrigerant passages 101, 103, and 105 may be understood as "branch passages" that are branched from the refrigerant tube 100.

The refrigerator 10 may further include a flow adjustment unit (or flow adjustment valve) 130 that branches and introduces the refrigerant into the first to third refrigerant passages 101, 103, and 105. The flow adjustment unit 130 may be understood as a device that operates the first and second evaporators 150 and 160 together, i.e., to adjust a flow of the refrigerant so that the refrigerant is branched and introduced into the first and second evaporators.

For example, the flow adjustment part 130 may include a four-way valve having one inflow part through which the refrigerant may be introduced and three discharge parts through which the refrigerant may be discharged. The three discharge parts of the flow adjustment unit 130 may be connected to the first to third refrigerant passages 101, 103, and 105, respectively. The refrigerant passing through the flow adjustment unit 130 may be branched and discharged into the first to third refrigerant passages 101, 103, and 105. The discharge parts connected to the first to third refrigerant passages 101, 103, and 105 may be called a "first discharge part", a "second discharge part", and a "third discharge part" in order.

At least one discharge part of the first to third discharge parts may be opened. When all the first to third discharge parts are opened, the refrigerant may flow through the first to third refrigerant passages 101, 103, and 105. When the first and second discharge parts are opened, and the third discharge part is closed, the refrigerant may flow through the first and second refrigerant passages 101 and 103.

A flow path of the refrigerant may vary according to the control of the flow adjustment unit 130. Also, the control of the flow adjustment unit 130 may be performed on the basis of whether the refrigerant within the first or second evaporator 150 or 160 is excessive or lack. When the first and second evaporators 150 and 160 operate at the same time, if the refrigerant within the first evaporator 150 is relatively lack, the flow adjustment unit 130 may be controlled so that the refrigerant flows into the first to third refrigerant passages 101, 103, and 105. If the refrigerant within the second evaporator 160 is relatively lack, the third refrigerant passage 105 may be closed, and the flow adjustment unit 130 may be controlled so that the refrigerant flows into the first and second refrigerant passages 101 and 103. The flow passages 101 and 105 of the refrigerant to be introduced into the first evaporator 150 may be provided in plurality, and the flow of the refrigerant may be selectively controlled through the plurality of flow passages 101 and 105 to adjust an amount of refrigerant to be introduced into the first or second evaporator 150 or 160. Since a greater amount of refrigerant flows into the inlet-side of the first evaporator 150 than the inlet-side of the second evaporator 160, when all of the first to third refrigerant passages 101, 103, and 105 are opened, a larger amount of refrigerant may flow into the first evaporator 150 than the second evaporator 160.

The refrigerator 10 may include blower fans 125, 155, and 165 provided on one side of the heat exchanger to blow air. The blower fans 125, 155, and 165 may include a condensation fan 125 provided on one side of the condenser 120, a first evaporation fan 155 provided on one side of the first evaporator 150, and a second evaporation fan 165 provided on one side of the second evaporator 160.

Each of the first and second evaporators 150 and 160 may vary in heat-exchange performance according to a rotation rate of each of the first evaporation fans 155 and 165. For example, if a large amount of refrigerant is required according to the operation of the evaporator 150, the first evaporation fan 155 may be increased in rotation rate. Also, if cool air is sufficient, the first evaporation fan 155 may be reduced in rotation rate.

Figure 3:
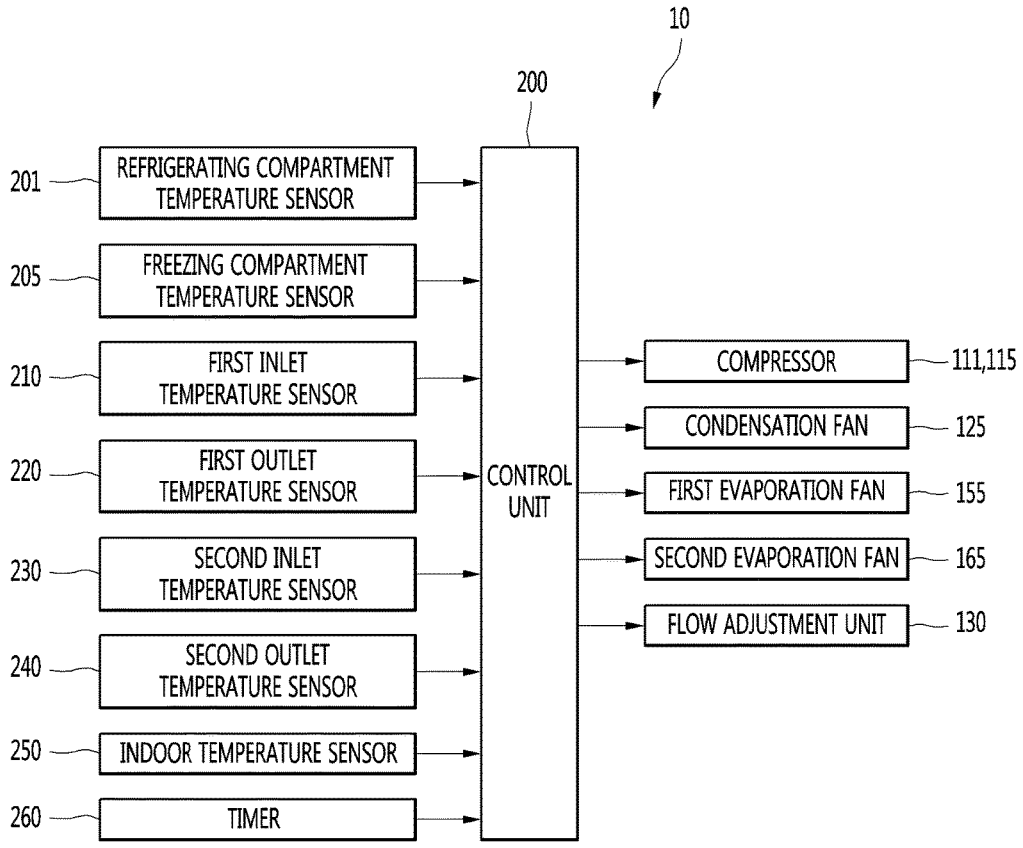
FIG. 3 is a block diagram of the refrigerator according to an embodiment.

Referring to FIG. 3, the refrigerator 10 according to the current embodiment may include storage compartment temperature sensors 201 and 205 that detect a temperature of the storage compartment. The storage compartment temperature sensors 201 and 205 may include a refrigerating compartment temperature sensor 201 that detects a temperature of the refrigerating compartment R and a freezing compartment temperature sensor 205 that detects a temperature of the freezing compartment F. The refrigerator 10 may further include a plurality of evaporator temperature sensors 210, 220, 230, and 240 that detect inlet or outlet temperatures of the first and second evaporators 150 and 160.

The plurality of evaporator temperature sensors 210, 220, 230, and 240 may include a first inlet temperature sensor 210 that detects an inlet-side temperature of the first evaporator 150 and a first outlet temperature sensor 220 that detects an outlet-side temperature of the first evaporator 150. The plurality of evaporator temperature sensors 210, 220, 230, and 240 may also include a second inlet temperature sensor 230 that detects an inlet-side temperature of the second evaporator 160 and a second outlet temperature sensor 240 that detects an outlet-side temperature of the second evaporator 160.

The refrigerator 10 may further include an indoor temperature sensor 250 that detects a temperature within a space in which the refrigerator 10 is installed, for example, an indoor space. Also, the refrigerator 10 may further include a timer to integrate an elapsed time when a preset operation is performed. The refrigerator 10 may further include a control unit (or controller) 200 to determine the temperature values detected by the plurality of evaporator temperature sensors 210, 220, 230, and 240 and the indoor temperature sensor 250 or a time value integrated by the timer 280. The control unit 200 may control the operations of the first and second compressors 111 and 115, the condensation fan 125 and the first and second evaporation fans 155 and 165, or the flow adjustment unit 130 to perform the simultaneous operation of the storage compartments R and F or the exclusive operation of a specific storage compartment, on the basis of the determined temperature value or time value.

After the refrigerator 10 is turned on, the first and second compressors 111 and 115 may be driven. While heat exchange occurs in the condenser 120 and the evaporators 150 and 160, the refrigeration cycle may operate. Each of the refrigerating compartment R and the freezing compartment F may be decreased in temperature as the refrigeration cycle operates.

Figure 4:
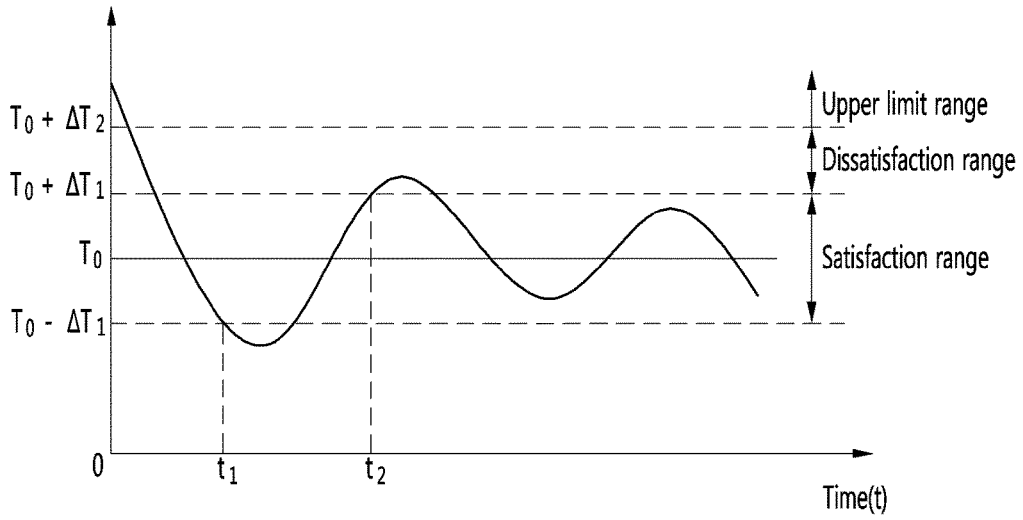
FIG. 4 is a graph illustrating a variation in temperature of a storage compartment of the refrigerator according to an embodiment.

FIG. 4 illustrates a state in which the temperature of the refrigerating compartment R or the freezing compartment F is increased or decreased according to the trend of a predetermined variation in temperature. For example, at a time 0, in a state in which the refrigeration cycle does not operate, the storage compartment R or F may have a relatively high temperature. The temperature may have a value that is similar to that of the inner space in which the refrigerator 10 is installed.

When the operation of the refrigeration cycle starts to supply cool air into the storage compartment R or F, the temperature of the storage compartment may decrease. When the supply of the cool air into the storage compartment is stopped, the temperature of the storage compartment may increase again. Then, when the increasing temperature is detected to restart the supply of the cool air, the temperature of the storage compartment may decrease.

When the user opens the refrigerator door, air outside the refrigerator may be introduced to increase the temperature of the storage compartment and the supply of the cool air may be performed to decrease the temperature of the storage compartment. The supply of the cool air according to the above-described pattern may be selectively performed in the refrigerating compartment R or the freezing compartment F to form a temperature variation curve as illustrated in FIG. 4. The temperature variation curve of FIG. 4 is merely one example. It is not necessary to form the temperate variation curve of FIG. 4. For example, the temperature variation curve may be changed according to relative temperature values of the refrigerating compartment R and the freezing compartment F or the refrigerator door opening pattern of the user.

The refrigerator 10 may define a preset temperature range (hereinafter, referred to as a control temperature range) to control the temperature of the storage compartment. The control temperature range may include a "satisfaction range (a first temperature range)", a "dissatisfaction range (a second temperature range)", and an "upper limit range (a third temperature range)".

The satisfaction range of the refrigerating compartment may be called a "refrigerating compartment satisfaction range", the satisfaction range of the freezing compartment may be called a "freezing compartment satisfaction range", and the dissatisfaction range of the refrigerating compartment and the freezing compartment may respectively be called a "refrigerating compartment dissatisfaction range" and a "freezing compartment dissatisfaction range". The upper limit ranges of the refrigerating compartment and the freezing compartment may be called a "refrigerating compartment upper limit range" and a "freezing compartment upper limit range".

The satisfaction range may be defined as a temperature range between a temperature value that is higher by a first set width $\Delta T1$ than a set temperature To of the storage compartment and a temperature value that is lower by the first set width $\Delta T1$ than the set temperature To of the storage compartment. That is, the satisfaction range may be understood as a temperature range between a temperature $To-\Delta T1$ and a temperature $To+\Delta T1$. The set temperature To may be a temperature value that is set by the user. The temperature $To-\Delta T1$ may be called a lower limit temperature of the satisfaction range, and the temperature $To+\Delta T1$ may be called an upper limit temperature of the satisfaction range.

The dissatisfaction range may be understood as a temperature range between the temperature $To+\Delta T1$ and a temperature $To+\Delta T2$. The temperature $\Delta T2$ may be a second set width that is greater than the first set width. The upper limit range may be understood as a temperature range that is above the temperature $To+\Delta T2$.

The refrigerator 10 may control the supply of the cool air into the storage compartment so that the temperature of the storage compartment is maintained in the satisfaction range. The satisfaction range may be called a first temperature range, the dissatisfaction range may be called a second temperature range, and the upper limit range may be called a third temperature range.

Referring to FIG. 4, the refrigerator 10 may be turned on, and the compressors 111 and 115 may be driven to supply the cool air into the storage compartment, thereby decreasing the temperature of the storage compartment. When the temperature of the storage compartment reaches the lower limit temperature $To-\Delta T1$ in the satisfaction range at a time t1, the supply of the cool air into the storage compartment may be stopped.

When the supply of the cool air is stopped, the temperature of the storage compartment may increase. When the temperature of the storage compartment reaches the upper limit temperature $To+\Delta T1$ in the satisfaction range at a time t2, the supply of the cool air into the storage compartment may be performed again. This pattern may be repeated, and thus the temperature of the storage compartment may be defined in the satisfaction range.

When the refrigerator 10 is turned on, and the refrigeration cycle operates, a difference between a high pressure (a discharge pressure of the compressor or a condensation pressure of the condenser) of the cycle and a low pressure (an evaporation pressure of the evaporator) of the cycle may be gradually increased. When a predetermined time elapses to stabilize the refrigeration cycle, each of the high pressure and the lower pressure of the cycle may be defined in a range of a preset operation pressure (hereinafter, referred to as a set operation pressure).

When the plurality of evaporators are respectively provided in the storage compartments, and the evaporation of the refrigerant is selectively performed according to a cooling mode of each of the storage compartments, i.e., a refrigerating compartment exclusive cooling operation mode, a freezing compartment exclusive cooling operation mode, and a simultaneous cooling operation mode of the refrigerating compartment and the freezing compartment, if the cooling operation of the corresponding storage compartment is stopped before an evaporation pressure of the refrigerant reaches the set operation pressure, the refrigeration cycle may operate in a state in which the evaporation pressure or the evaporation temperature are maintained in a relatively high state. In this case, the refrigerant passing through the evaporator having a relatively high evaporation temperature may be increased in temperature, and thus, the storage compartment may not be sufficiently cooled.

In the current embodiment, when the refrigerator 10 is turned on to drive the refrigeration cycle, the temperature of the storage compartment may reach the lower limit temperature $To-\Delta T1$ at least one time. The low pressure of the refrigeration cycle is defined in the pressure range of the set operation low pressure, and thus, even though the temperature of the storage compartment is changed, the low pressure of the refrigeration cycle may be controlled to be changed in the satisfaction range.

Even though the temperature value of the storage compartment may be in the satisfaction range, the method for controlling the refrigerator may be changed based on whether the temperature of the storage compartment reaches the lower limit temperature in the satisfaction range. When the temperature value of the storage compartment reaches the lower limit temperature in the satisfaction range at least one time, it may be recognized as a "once satisfaction" state. When the temperature value does not reach the lower limit temperature in the satisfaction range at all, it may be recognized as a "once dissatisfaction" state. That is, whether the "once satisfaction" state is reached may be determined when the temperature of the storage compartment is in the satisfaction range.

TABLE 1

| Temperature of freezing compartment (F) | Temperature of refrigerating compartment (R) | Whether temperature of refrigerating compartment (R) is satisfied once | Operation (control) mode |
|---|---|---|---|
| Upper limit range | Upper limit range | | R/F simultaneous operation |
| | Dissatisfaction range | | R/F simultaneous operation |
| | Satisfaction range | Once satisfaction | F cooling operation |
| | | Once dissatisfaction | R/F simultaneous operation |

In a state in which the refrigerator 10 operates, temperature values of the freezing compartment F and the refrigerating compartment R may be detected by using the freezing compartment temperature sensor 205 and the refrigerating compartment temperature sensor 201. Table 1 shows an operation (control) mode of the refrigerator when the temperature of the freezing compartment F is in the upper limit range.

When the temperature of the freezing compartment F is in the upper limit range, and the temperature of the refrigerating compartment R is in the upper limit range, i.e., when all the temperatures of the storage compartments R and F are defined as values that are above the satisfaction range, the simultaneous operation of the storage compartments R and F may be controlled to be performed. When the simultaneous operation of the storage compartments R and F is performed, the first and second compressors 111 and 115 may be driven, and the flow adjustment unit 130 may be controlled to supply the refrigerant into both the first and second evaporators 150 and 160.

When the temperature of the freezing compartment F is in the upper limit range, and the temperature of the refrigerating compartment R is in the satisfaction range, whether the refrigerating compartment R satisfies the "once satisfaction" state may be determined. When the refrigerating compartment R satisfies the "once satisfaction" state, the low pressure of the refrigeration cycle may reach the set operation low pressure. The refrigerating compartment R may be determined to be in a stable temperature range, and the exclusive cooling operation of the freezing compartment F may be performed. When the exclusive cooling operation of the freezing compartment F is performed, the first and second compressors 111 and 115 may be driven, and the flow adjustment unit 130 may be controlled to supply the refrigerant into only the second evaporator 160. When the "once satisfaction" state is not satisfied, i.e., in case of the "once dissatisfaction" state, it may be determined that the refrigerating compartment R is not sufficiently cooled yet, and thus, the simultaneous cooling operation of the storage compartments R and F may be performed.

TABLE 2

| Temperature of freezing compartment (F) | Temperature of refrigerating compartment (R) | Whether temperature of refrigerating compartment (R) is satisfied once | Operation (control) mode |
|---|---|---|---|
| Dissatisfaction range | Upper limit range | | R/F simultaneous operation |
| | Dissatisfaction range | | R cooling operation (indoor temperature is within set range) |
| | | | R/F simultaneous operation (indoor temperature is out of set range) |
| | Satisfaction range | Once satisfaction | F cooling operation |
| | | Once dissatisfaction | R cooling operation (indoor temperature is within set range) |
| | | | R/F simultaneous operation (indoor temperature is out of set range) |

Table 2 shows an operation (control) mode of the refrigerator when the temperature of the freezing compartment F is in the dissatisfaction range. When the temperature of the freezing compartment F is in the dissatisfaction range, and the temperature of the refrigerating compartment R is in the dissatisfaction range, i.e., when all the temperatures of the storage compartments R and F are defined as values that are above the satisfaction range, the simultaneous operation of the storage compartments R and F may be controlled to be performed.

When the temperature of the freezing compartment F is in the dissatisfaction range, and the temperature of the refrigerating compartment R is in the dissatisfaction range, the temperature of the installation space (the indoor space) in which the refrigerator 10 is installed may be detected by using the indoor temperature sensor 250. When the temperature of the indoor space (or ambient temperature) belongs to the set range, the cooling operation of the refrigerating compartment R may be controlled to be performed. When the temperature of the indoor space is outside of the set range, the simultaneous operation of the refrigerating compartment R and the freezing compartment F may be controlled to be performed. When the exclusive cooling operation of the refrigerating compartment R is performed, only the first compressor 111 may be driven, and the flow adjustment unit 130 may be controlled to supply the refrigerant to the first evaporator 150.

As a general rule, when all the temperatures of the storage compartments R and F belong to the dissatisfaction range, the simultaneous cooling operation of the refrigerating compartment R and the freezing compartment F may be performed. However, when the simultaneous operation is performed, power consumption may be increased by a difference in operation of the compressor or fan when compared to the exclusive operation.

When the temperatures of the storage compartments R and F are in the dissatisfaction range, a difference in temperature between the storage compartment and the satisfaction range is not very large. Thus, only one storage compartment of the refrigerating compartment R and the freezing compartment F may be cooled to decrease the temperature of the other storage compartment through the later cooling even though the temperature of the other storage compartment is increased. To reduce power consumption in addition to an efficient cooling operation, the refrigerator according to the current embodiment may not perform the simultaneous operation of the refrigerating compartment and the freezing compartment, but perform the exclusive cooling operation.

For example, the storage compartment in which the exclusive cooling operation is performed may be selected as the storage compartment which has a relative consumer's reliability requirement of the refrigerating compartment R and the freezing compartment F. The storage compartment may be selected as the storage compartment having a relatively large capacity. In the current embodiment, the refrigerating compartment R may be selected as the storage compartment. When the temperatures of the refrigerating compartment R and the freezing compartment F are in the dissatisfaction range, and the indoor temperature is in the set range, the exclusive cooling operation of the refrigerating compartment R may be performed.

The set range may be determined as a general temperature range in the indoor space in which the refrigerator is installed. For example, the set range may be determined as a temperature range of about 18° C. to about 27° C.

When the indoor temperature corresponds to a temperature range outside of the set range, particularly, a temperature that is above the set range, the simultaneous operation of the storage compartment R and the freezing compartment F may be performed in principle. Particularly, when the indoor temperature is defined as a temperature that is above the set range, the condensation temperature may be increased, and thus, the evaporation pressure or the evaporation temperature may be increased together with the condensation temperature to limit the cooling effect of the storage compartments. Even though the power consumption is increased somewhat, the simultaneous operation of the storage compartments may be performed to secure the cooling performance.

Referring again to Table 2, when the temperature of the freezing compartment F is in the dissatisfaction range, and the temperature of the refrigerating compartment R is in the satisfaction range, whether the refrigerating compartment R satisfies the "once satisfaction" state may be determined. When the refrigerating compartment R satisfies the "once satisfaction" state, the low pressure of the refrigeration cycle may reach the set operation low pressure. The temperature of refrigerating compartment R may be determined to be in a stable temperature range, and the exclusive cooling operation of the freezing compartment F may be performed.

On the other hand, when the "once satisfaction" state is not satisfied, i.e., in case of the "once dissatisfaction" state, it may be determined that the refrigerating compartment R is not sufficiently cooled yet. In this case, although the simultaneous cooling operation of the storage compartments R and F is performed, when the indoor temperature is in the set temperature range, the exclusive cooling operation of the refrigerating compartment R may be performed to reduce the power consumption. On the other hand, when the indoor temperature is in a temperature range outside of the set temperature range, the simultaneous cooling operation of the storage compartments R and F may be performed.

TABLE 3

| Temperature of freezing compartment (F) | Whether temperature of refrigerating compartment (R) is satisfied once | Temperature of refrigerating compartment (R) | Operation (control) mode |
|---|---|---|---|
| | Once satisfaction | Upper limit range | R cooling operation (indoor temperature is within set range)<br>R/F simultaneous operation (indoor temperature is out of set range) |
| | Once dissatisfaction | | R/F simultaneous operation |
| | | Dissatisfaction range | R cooling operation (indoor temperature is within set range)<br>R/F simultaneous operation (indoor temperature is out of set range) |
| | | Satisfaction range | Operation off |

Table 3 shows an operation (control) mode of the refrigerator when the temperature of the freezing compartment F is in the satisfaction range. When the temperature of the freezing compartment F is in the satisfaction range, whether the freezing compartment F satisfies the "once satisfaction" state may be determined. When the temperature of the freezing compartment F satisfies the "once satisfaction" state, and the temperature of the refrigerating compartment R is in the upper limit range, the cooling operation of the refrigerating compartment R is performed when the indoor temperature is in the set range, and the simultaneous operation of the storage compartments R and F may be performed when the indoor temperature is in a temperature range outside of the set range.

Since the freezing compartment F satisfies the "once satisfaction" state, the exclusive cooling operation of the refrigerating compartment R may be a normal operation. However, when the indoor temperature is out of the set range, i.e., when the indoor temperature has a relatively high temperature, a phenomenon in which the temperature of the freezing compartment F is quickly increased by a difference in temperature between the inner temperature of the freezing compartment F and the indoor temperature may occur. Thus, the simultaneous operation of the storage compartments R and F may be performed to prevent the temperature of the freezing compartment F from being increased.

When the freezing compartment F is in the "once dissatisfaction" state, and the temperature of the refrigerating compartment R is in the upper limit range, the simultaneous operation of the storage compartments R and F may be performed to induce the cooling of the refrigerating compartment R and the freezing compartment F. When the temperature of the freezing compartment F is in the satisfaction range, and the temperature of the refrigerating compartment R is in the dissatisfaction range, the indoor temperature may be detected. Like the case in which the temperature of the refrigerating compartment R is in the upper limit range, when the indoor temperature is in the set range, the cooling operation of the refrigerating compartment R may be performed, and when the indoor temperature is outside of the set range, the simultaneous operation of the storage compartments R and F may be performed.

However, in this case, whether the temperature of the freezing compartment F satisfies the "once satisfaction" state may not be determined. When the temperature of the freezing compartment F is in the "once dissatisfaction" state, and the temperature of the refrigerating compartment is in the dissatisfaction range, the simultaneous operation of the storage compartments R and F may be performed. To reduce the power consumption, the exclusive operation or the simultaneous operation of the storage compartments R and F may be performed according to the indoor temperature. Thus, as shown in Table 3, when the temperature of the refrigerating compartment R is in the dissatisfaction range, and the temperature of the freezing compartment F is in the satisfaction range, whether the freezing compartment F is in the "once satisfaction" state may not be determined. According to the above-described control method, the control of the refrigerator may be simplified.

Figure 5:
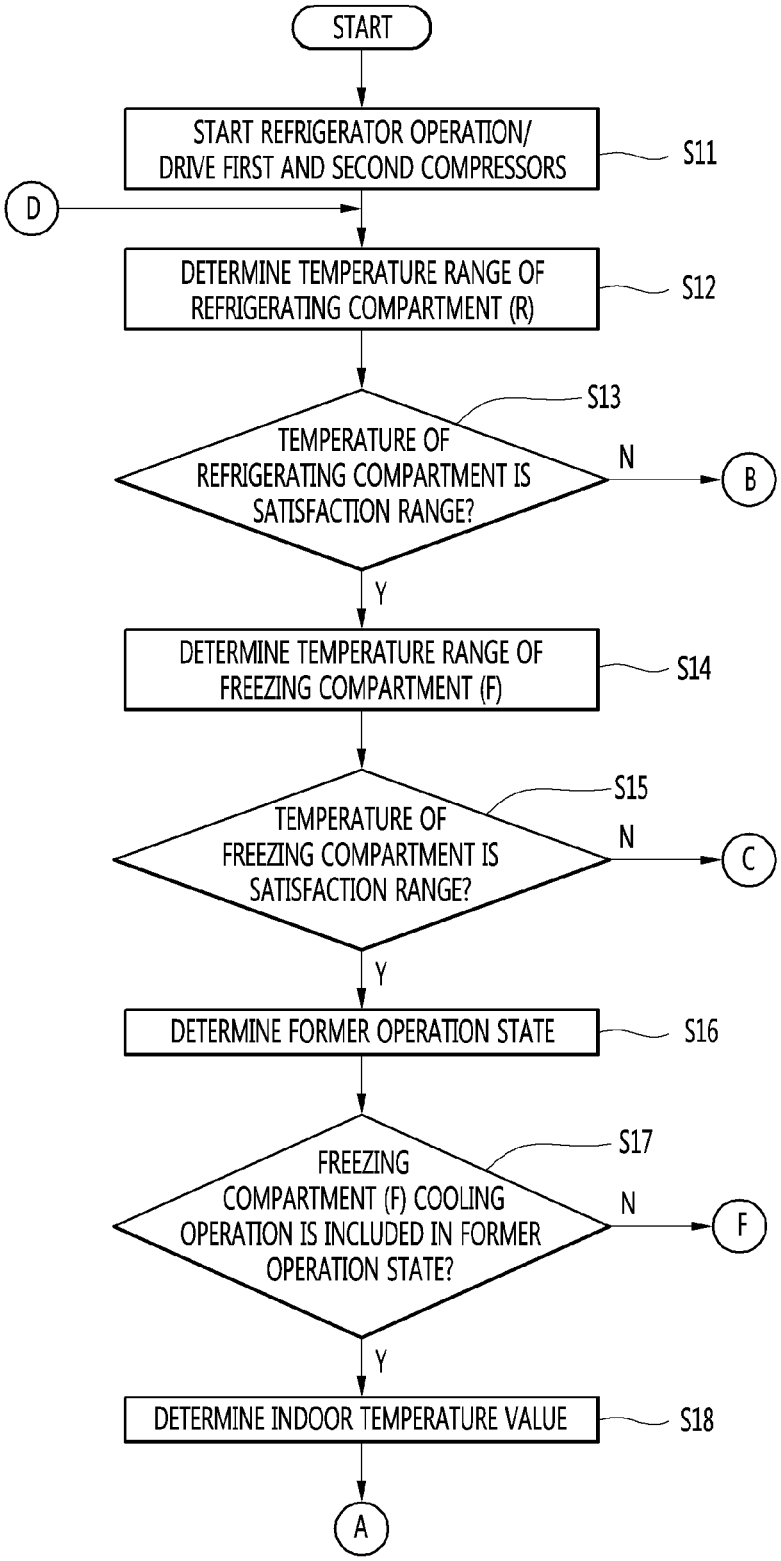
FIGS. 5 to 8 are flowcharts illustrating a method for controlling the refrigerator during a normal operation of the refrigerator according to an embodiment.
Figure 6:
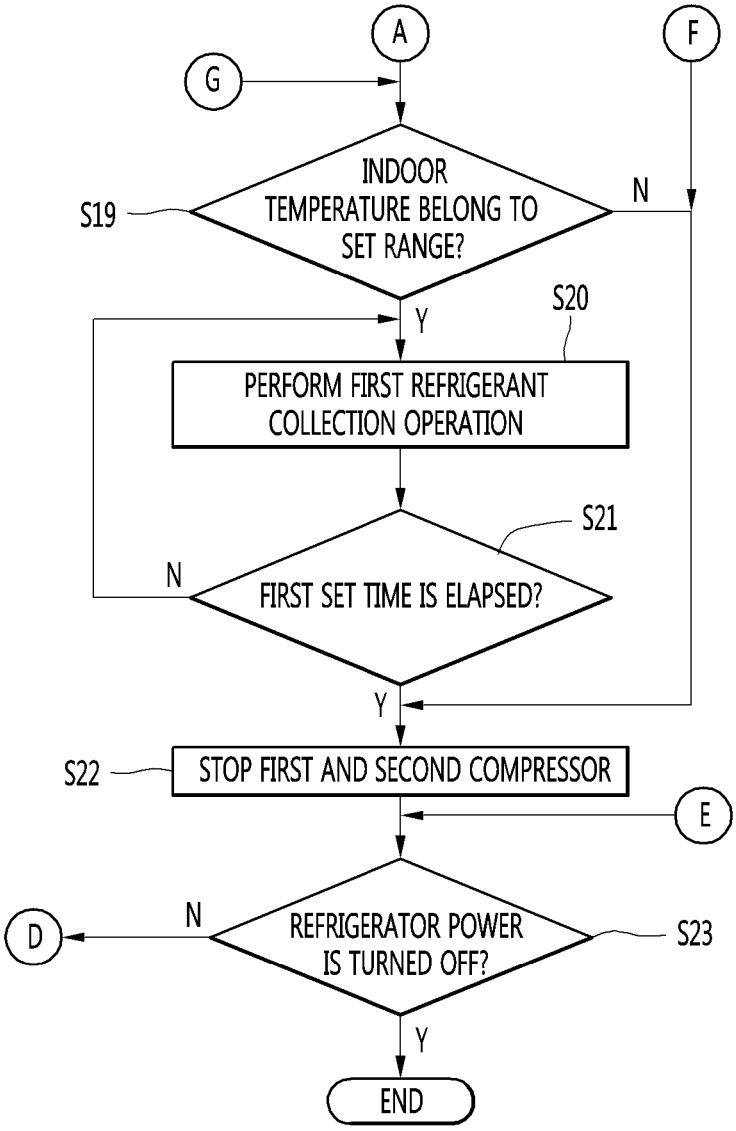
Figure 8:
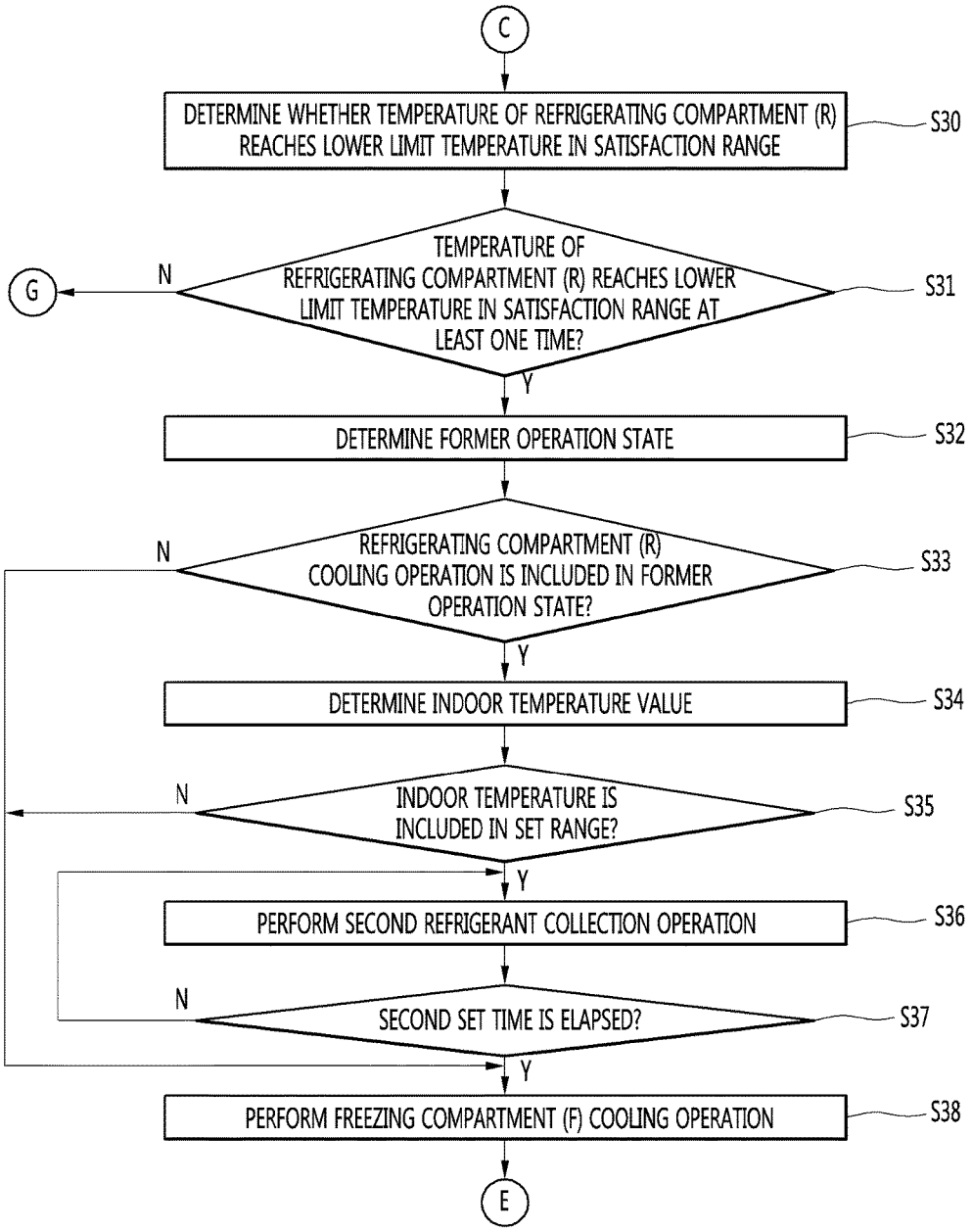

Referring to FIGS. 5 and 8, when first and second compressor 111 and 115 may be driven to start an operation of a refrigerator 10, a temperature value of a refrigerating compartment R may be determined. Also, whether the determined temperature of the refrigerating compartment R is in a satisfaction range may be determined (S11 and S12). When the temperature of the refrigerating compartment R is in the satisfaction range, whether a temperature of a freezing compartment F is in the satisfaction range may be determined (S13, S14, and S15).

When the temperature of the freezing compartment F is in the satisfaction range, a former operation state of the refrigerator may be determined. The former operation state may be a state in which a cooling operation of the refrigerating compartment R or the freezing compartment F is performed before a time point at which all the temperatures of the refrigerating compartment R and the freezing compartment F belong to the satisfaction range. When a simultaneous cooling operation of the storage compartments R and F is performed, cooling operations of the refrigerating compartment R and the freezing compartment F may be performed (S16).

When the cooling operation of the freezing compartment F is included in the former operation state, an indoor temperature value may be determined (S17 and S18). When the determined indoor temperature value is in the set range, a first refrigerant collection operation is performed. For example, the set range may be determined as a temperature range of about 18° C. to about 27° C. The set range may be generally understood as a temperature of the indoor space in which the refrigerator is installed.

When the determined indoor temperature value is outside of the set range, a first refrigerant collection operation may not be performed. When the first refrigerant collection operation is performed, since the cooling operations of the storage compartments R and F are stopped, the refrigerant collection operation may not be performed to prevent cooling performance from being deteriorated. Particularly, when the determined indoor temperature value is above the set range, if the cooling operations of the storage compartments are stopped, the temperatures of the storage compartments may be quickly increased. The first refrigerant collection operation may be performed to prevent this phenomenon from occurring.

The first refrigerant collection operation may be performed after the cooling operation of the freezing compartment F is performed. The first refrigerant collection operation may involve transferring a refrigerant into the condenser 120. When the first refrigerant collection operation is performed, the flow adjustment unit 130 may be closed to restrict the supply of the refrigerant into the first and second evaporators 150 and 160. Each of the first and second evaporation fans 155 and 165 may be driven at a low speed, and the condensation fan 125 may not be driven (S19 and S20).

When the first refrigerant collection operation is performed, an elapsed time may be integrated. Whether the integrated time elapses a first set time may be determined. For example, the first set time may be determined as a time range of about 80 seconds to about 100 seconds. The first set time may be determined as a time longer than a second set time that is a reference time when a second refrigerant collection operation is performed (S21). When the first set time is elapsed, the first and second compressors 111 and 115 may be stopped (S22).

This control method may be repeatedly performed until power of the refrigerator 10 is turned off. If a power off command of the refrigerator 10 is not generated, the processes after the operation S12 may be continuously performed (S23). In the operation S13, when the temperature of the refrigerating compartment R is outside of the satisfaction range, the indoor temperature value may be determined (S24).

When the indoor temperature value is within the set range, whether a load corresponding operation condition is satisfied may be determined (S28). The load corresponding operation condition may represent a case in which a temperature of one storage compartment is significantly increased, and a temperature of the other storage compartment satisfies a specific condition. Under the load corresponding operation condition, when the user frequently opens the refrigerating compartment door or leaves the refrigerating compartment open for an extended period of time, the temperature of the refrigerating compartment R may be increased up to the upper limit range, and the freezing compartment F may be in the "once dissatisfaction" state.

When the load corresponding operation condition is satisfied, the simultaneous operation of the refrigerating compartment R and the freezing compartment F may be performed. When the load corresponding operation condition is not satisfied, the exclusive cooling operation of the refrigerating compartment R may be performed to reduce the power consumption (see Table 1 to Table 3) (S27, S28, and S29). In the operation S25, when the indoor temperature corresponds to a temperature range outside of the set range, i.e., a temperature that is above the set range, the simultaneous operation of the storage compartment R and the freezing compartment F may be performed (see Table 1 to Table 3).

In the operation S15, when the temperature of the freezing compartment F is outside of the satisfaction range, whether the temperature of the refrigerating compartment R reaches the lower limit temperature in the satisfaction range, i.e., whether the refrigerating compartment R satisfies the "once satisfaction" state is determined (S30). When the temperature of the refrigerating compartment R satisfies the "once satisfaction" state, a former operation state may be determined (S31 and S32).

When the former operation state includes the cooling operation of the refrigerating compartment R, the indoor temperature value may be determined. Whether the determined indoor temperature value belongs to the set range may also be determined. When the determined indoor temperature value belongs to the set range, a second refrigerant collection operation is performed.

Conversely, when the determined indoor temperature value is outside of the set range, the second refrigerant collection operation may not be performed. When the second refrigerant collection operation is performed, since the cooling operations of the storage compartments R and F are stopped, the refrigerant collection operation may not be performed in order to prevent cooling performance from being deteriorated (S33, S34, and S35).

The second refrigerant collection operation may be performed after the cooling operation of the refrigerating compartment R is performed. The first refrigerant collection operation may be understood as a refrigerant collection operation that transfers a refrigerant into the condenser 120. When the second refrigerant collection operation is performed, the flow adjustment unit 130 may be closed to restrict the supply of the refrigerant into the first and second evaporators 150 and 160. The first evaporation fan 155 may be driven at a low speed, and the second evaporation fan 165 may be driven at a middle speed (S36).

When the second refrigerant collection operation is performed, an elapsed time may be integrated. Whether the integrated time elapses a second set time may be determined. For example, the second set time may be determined as a time range of about 20 seconds to about 40 seconds. The second set time may be determined as a time shorter than the first set time which may be a reference time when the above-described first refrigerant collection operation is performed.

When the first refrigerant collection operation is performed in the state in which the cooling operation of the freezing compartment F is performed, a relatively large amount of processes may be required so that the refrigerant of the second evaporator 160, which has a relatively low pressure, may flow into the condenser 120 via the first and second compressors 111 and 115. Since a difference between the refrigerant pressure of the second evaporator 160 and the pressure of each of the first and second compressors 111 and 115 is large, the refrigerant collection operation may be performed for a relatively long time.

When the second refrigerant collection operation is performed in the state in which the cooling operation of the refrigerating compartment R is performed, a relatively small amount of processes may be required so that the refrigerant of the first evaporator 150, which has a relatively high pressure, may flow into the condenser 120 via the first compressor 111. Since a difference between the refrigerant pressure of the first evaporator 150 and the pressure of the first compressor 111 may be small, the refrigerant collection operation may be performed for a relatively short time (S37). When the second set time is elapsed, the cooling operation of the freezing compartment F may be performed (S38).

Figure 7:
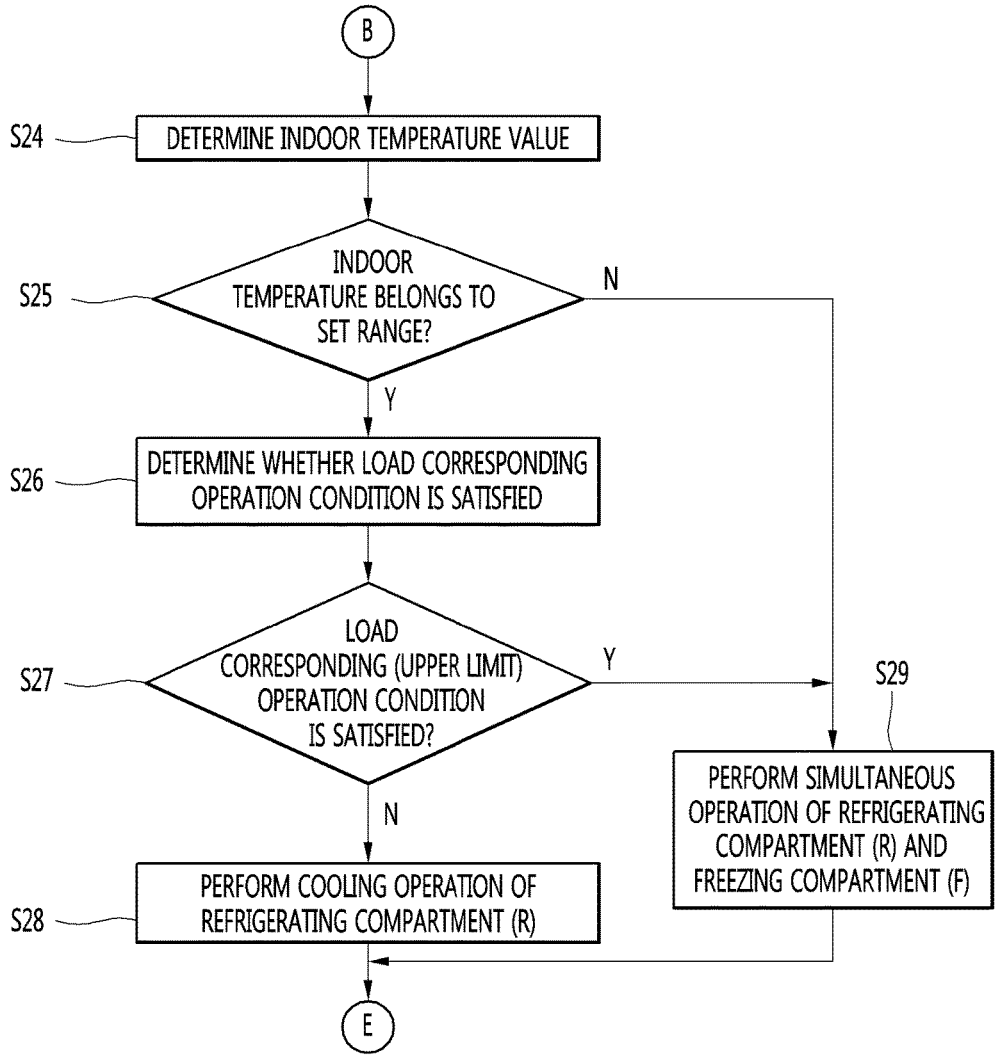
Figure 9:
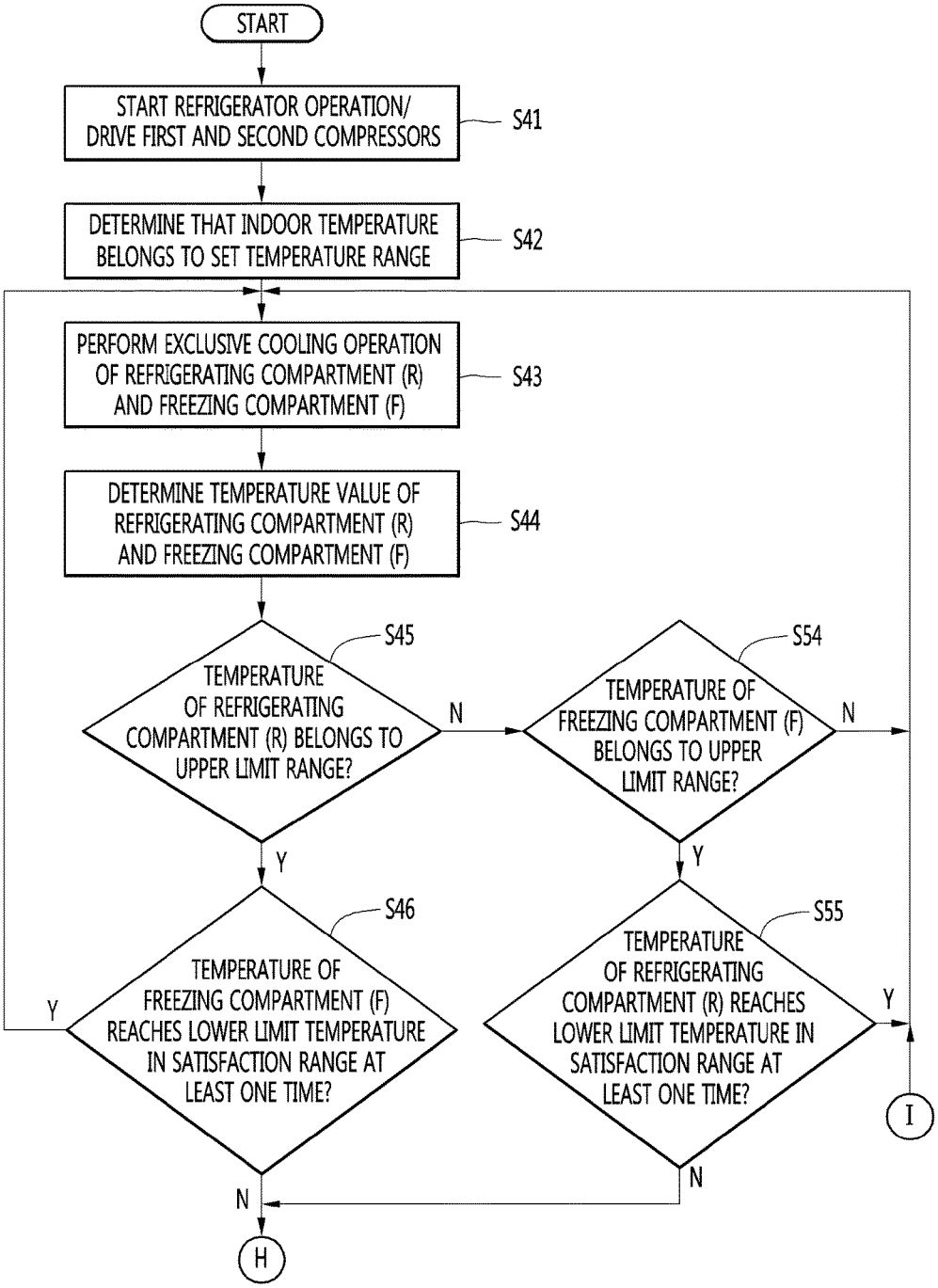
FIGS. 9 and 10 are flowcharts illustrating a method for controlling the refrigerator during a load corresponding operation of the refrigerator according to an embodiment.
Figure 10:
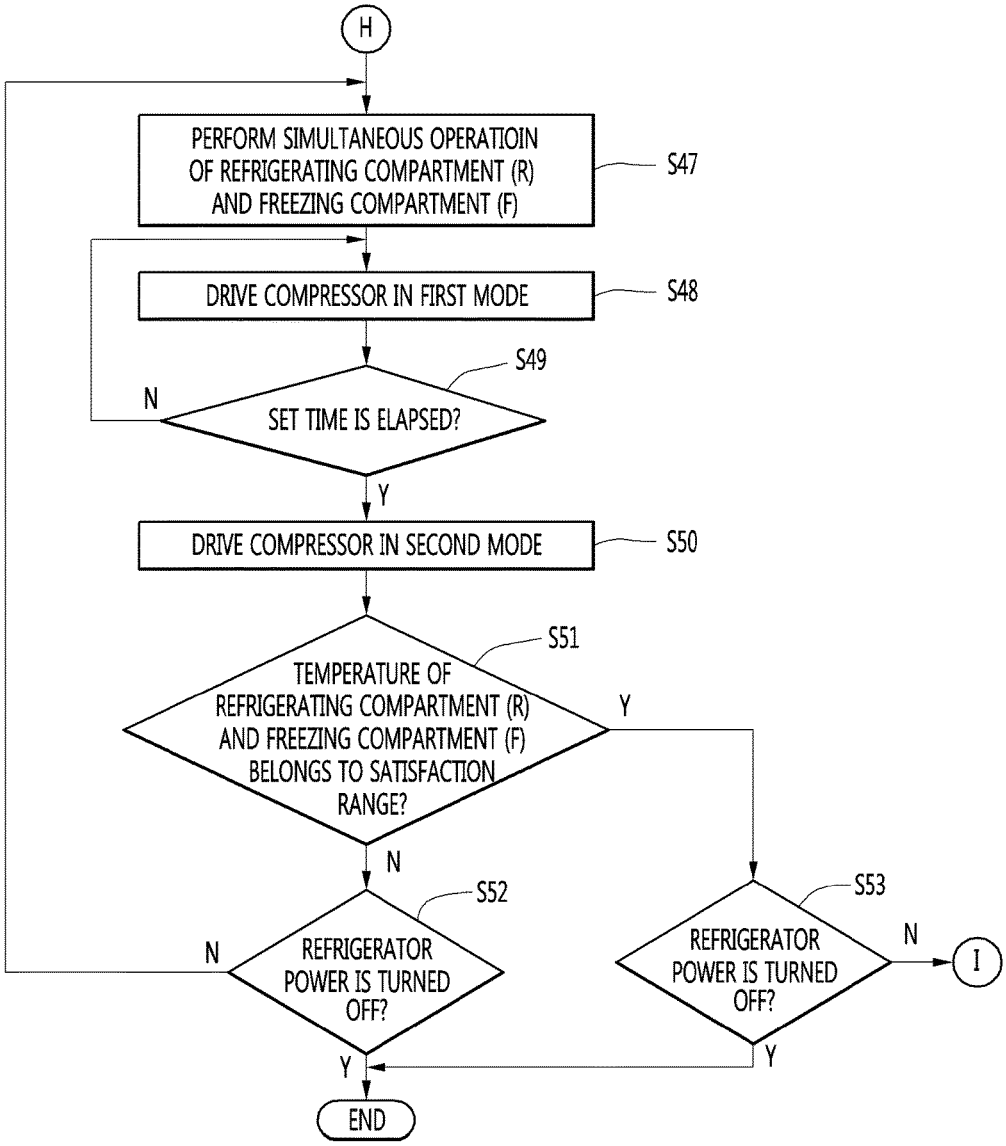

Referring to FIGS. 9 and 10, if the indoor temperature is within the set range, when the load corresponding condition of the refrigerator is satisfied, for example, when the temperature of the refrigerating compartment R or the freezing compartment F belongs to the upper limit range, a method for controlling the process in which the exclusive operation or the simultaneous operation of the storage compartments is performed is illustrated. Also, in FIGS. 9 and 10, the specific processes of the operations S26 to S29 of FIG. 7 may be illustrated. When the first compressor 111 or the second compressor 115 is driven to start the operation of the refrigerator, whether the indoor temperature is within the set range may be determined (S41 and S42).

The exclusive cooling operation of the freezing compartment F or the exclusive cooling operation of the refrigerating compartment R, which are described with reference to Table 1 to Table 3, may be performed. The exclusive cooling operation of the refrigerating compartment R, which is described in the operation S28 of FIG. 7 and the exclusive cooling operation of the freezing compartment F, which is described in the operation S38 of FIG. 8 may correspond to this process (S43). The temperature values of the refrigerating compartment R and the freezing compartment F may also be determined (S44).

Here, whether the temperature of the refrigerating compartment R is within the upper limit range may be determined. When the temperature of the refrigerating compartment R is within the upper limit range, and the temperature of the freezing compartment F reaches the lower limit temperature at least one time, i.e., in case of the "once satisfaction" state, the process may return to the operation S4 to perform the cooling operation of the refrigerating compartment R (S45 and S46) (see Table 3). When the temperature of the refrigerating compartment R is within the upper limit range, and the temperature of the freezing compartment F is in the "once dissatisfaction" state, the simultaneous operation of the refrigerating compartment R and the freezing compartment F may be performed (S47) (see Table 3).

In the operation S45, when the temperature of the refrigerating compartment R is outside of the satisfaction range, and the temperature of the freezing compartment F is within the upper limit range, whether the temperature of the refrigerating compartment R reaches the lower limit temperature in the satisfaction range at least one time, i.e., whether the temperature of the refrigerating compartment R is in the "once satisfaction" state may be determined (S54 and S55).

When the refrigerating compartment R is in the "once satisfaction" state, the process returns to operation S43 to perform the cooling operation of the freezing compartment F (see Table 1). When the temperature of the refrigerating compartment R is outside of the lower limit range, and the temperature of the refrigerating compartment R is in the "once dissatisfaction" state, the simultaneous operation of the refrigerating compartment R and the freezing compartment F may be performed (see Table 1). In the operation S54, when the temperature of the freezing compartment F is outside of the upper limit range, the cooling operation of the refrigerating compartment R or the cooling operation of the freezing compartment F may be performed (see Tables 2 and 3).

When the simultaneous operation of the storage compartments R and F is performed, the first and second compressors 111 and 115 may operate in a first mode (S48). The first mode of the compressor may be a normal mode in which a plurality of terminals (a save terminal, a common terminal, and a power terminal) are switched by using a first manner to output a set cooling force. The elapsed time of the simultaneous operation may be integrated, and whether the simultaneous operation is performed for the set time may be determined. When the simultaneous operation is not performed for at best the set time, the compressor may continuously operate in the first mode (S49).

When the simultaneous operation is performed for the set time or more, the first and second compressors 111 and 115 may be switched into a second mode to operate. The second mode of the compressor may be a power mode in which the plurality of terminals (the save terminal, the common terminal, and the power terminal) are switched by using a second manner to output the set cooling force (S50).

While the first and second compressors 111 and 115 operate in the second mode, the temperatures of the refrigerating compartment R and the freezing compartment F may be continuously detected. When the temperature of at least one storage compartment of the refrigerating compartment R and the freezing compartment R does not reach the satisfaction range, the second mode of each of the first and second compressors 111 and 115 may be continuously performed. When the temperature of the at least one storage compartment reaches the satisfaction range, the process returns to operation S43 (S51).

While the first and second compressors 111 and 115 operate in the first mode, when the temperature of at least one storage compartment of the refrigerating compartment R and the freezing compartment R reaches the satisfaction range, the process returns to the operation S43. This control method may be repeatedly performed until power of the refrigerator 10 is turned off (S52 and S53).

According to the above-described control method, when the temperature of at least one storage compartment of the refrigerating compartment R and the freezing compartment R is within the upper limit range and the other storage compartment is not in the "once satisfaction" state, the simultaneous operation of the refrigerating compartment R and the freezing compartment F may be performed to improve the cooling performance of the storage compartments. When the temperature of one storage compartment is within the upper limit range, and the other storage compartment is in the "once dissatisfaction" state, if only the cooling of the storage compartment having the temperature belonging to the upper limit range is performed, the temperature of the other storage compartment may belong to the dissatisfaction range. Thus, the current embodiment may prevent this limitation from occurring.

Figure 11:
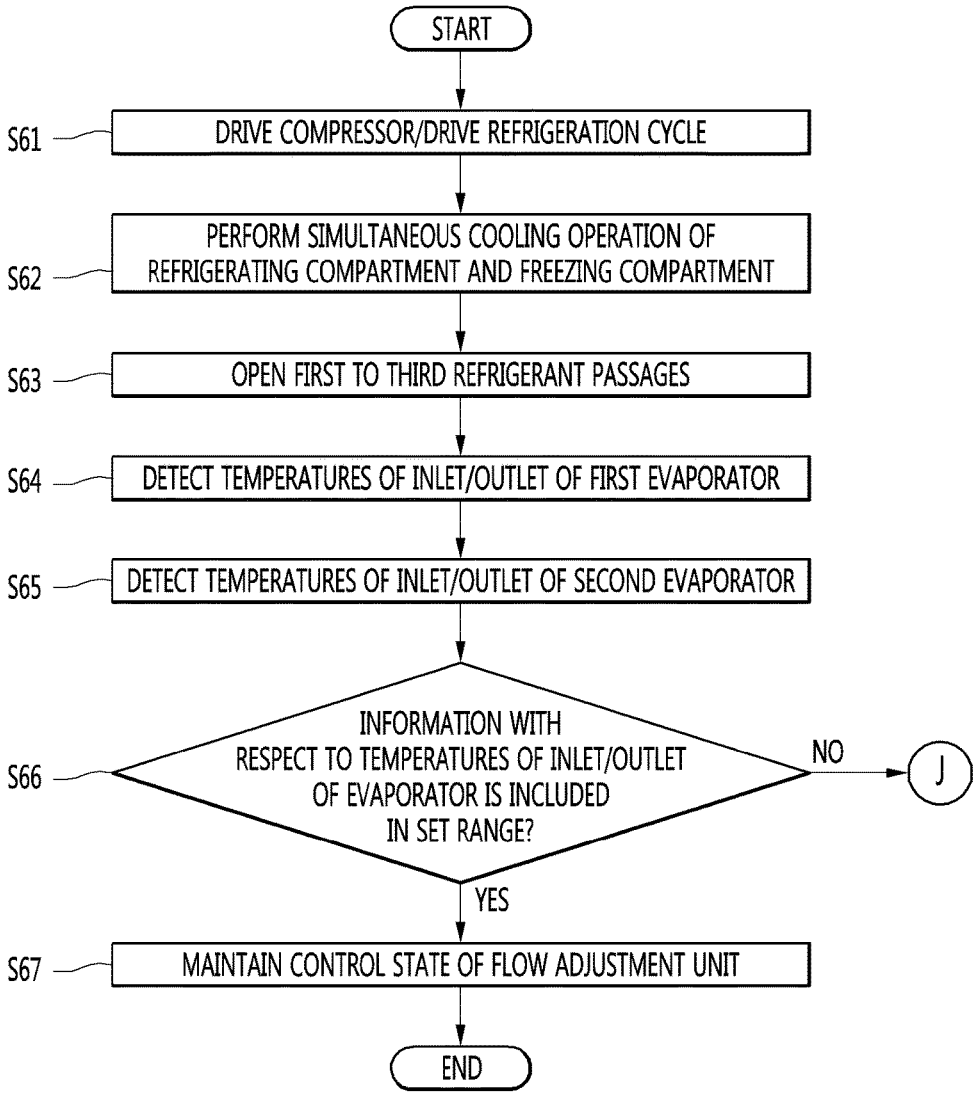
FIGS. 11 and 12 are flowcharts illustrating a method for controlling the refrigerator during a simultaneous operation of the refrigerator according to an embodiment.
Figure 12:
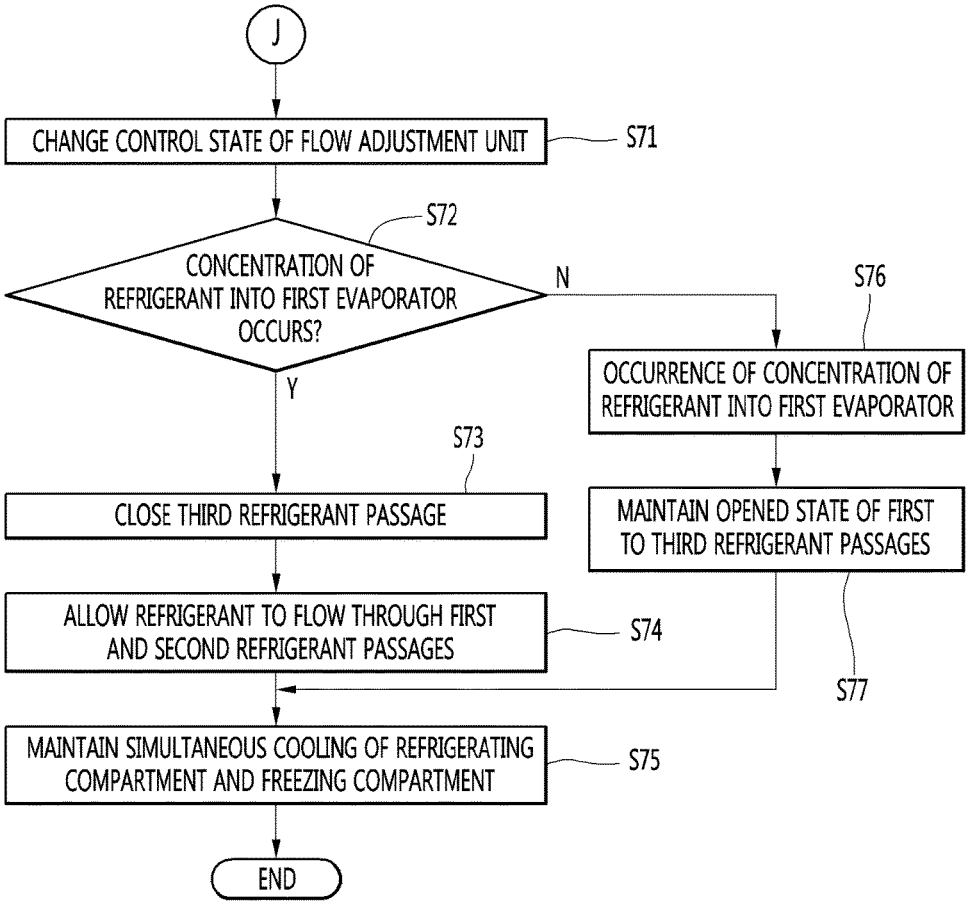

FIGS. 11 and 12 are flowcharts illustrating a method for controlling the refrigerator during the simultaneous operation of the refrigerator according to another embodiment. A method for controlling the refrigerator according to the current embodiment will be described with reference to FIGS. 11 and 12. To cool the refrigerator, the first and second compressor 111 and 115 may be driven. A refrigeration cycle according to the compression-condensation-expansion-evaporation of the refrigerant may be driven according to the driving of the compressor 111 or 115. The refrigerant evaporated in the second evaporator 160 may be compressed in the second compressor 115, and the compressed refrigerant may be mixed with the refrigerant evaporated in the first evaporator 150. The mixture may then be introduced into the first compressor 111 (S61).

The simultaneous cooling operation of the refrigerating compartment and the freezing compartment may be performed according to the operation of the refrigeration cycle. To perform the simultaneous cooling operation of the refrigerating compartment and the freezing compartment, the flow adjustment unit 130 may be controlled to open the first to third refrigerant passages 101, 103, and 105. When the first to third refrigerant passages 101, 103, and 105 are opened, the refrigerant may be introduced into the first and second evaporators 150 and 160. The refrigerant may then be heat-exchanged in the first and second evaporators 150 and 160 to supply the cool air into the refrigerating compartment R and the freezing compartment F.

A relatively large amount of refrigerant may be provided into the first evaporator 150. An amount of refrigerant that is heat-exchanged in the first evaporator 150 may be greater than an amount of refrigerant that is heat-exchanged in the second evaporator 160. Thus, a cooling load of the refrigerant supplied into the storage compartment in which the first evaporator 150 is provided, i.e., the refrigerating compartment, may be increased (S62 and S63).

Inlet and outlet temperatures of the first evaporator 150 may be detected by first inlet and outlet temperature sensors 210 and 220, respectively. The inlet and outlet temperatures of the second evaporator 160 may be detected by the second inlet and outlet temperature sensors 230 and 240, respectively (S64 and S65). The control unit 200 may determine an inlet/outlet temperature difference value of the first evaporator 150 and an inlet/outlet temperature difference value of the second evaporator 160.

When an amount of refrigerant introduced into the first or second evaporator 150 or 160 is above an adequate refrigerant amount, the difference value between the inlet and outlet temperatures of the first or second evaporator 150 and 160 may be relatively low. Conversely, when an amount of refrigerant introduced into the first or second evaporator 150 or 160 is below the adequate refrigerant amount, the difference value between the inlet and outlet temperatures of the first or second evaporator 150 or 160 may be relatively high.

The control unit 200 may determine whether the difference value between the inlet and outlet temperatures of the first or second evaporator 150 or 160 is within the set range. The control unit 200 may determine whether an amount of refrigerant flowing into the first or second evaporator 150 or 160 is excessive or lack, i.e., whether the refrigerant is concentrated into the first or second evaporator 150 or 160, on the basis of the inlet/outlet temperature difference of the first evaporator 150 and the inlet/outlet temperature difference of the second evaporator 160. Whether the amount of refrigerant flowing into the first or second evaporator 150 or 160 is excessive or lack may be determined on the basis of the inlet/outlet temperature difference of the first evaporator 150 and the inlet/outlet temperature difference of the second evaporator 160, or a ratio of the inlet/outlet temperature differences of the first and second evaporators 150 and 160 (S66).

As an example of the determination method, whether the refrigerant is concentrated according to whether the inlet/outlet temperature difference of the first evaporator 150 is equal to or greater or less than the preset reference value may be determined. The refrigerant circulated into the refrigeration cycle may be divided into the first and second evaporators 150 and 160 through the flow adjustment unit 130. When the inlet/outlet temperature difference of the first evaporator 150 is detected, a rate of the refrigerant passing through the first evaporator 150 may be determined. A rate of the refrigerant passing through the second evaporator 160 may be determined on the basis of the rate of the refrigerant passing through the first evaporator 150. For example, when the inlet/outlet temperature difference of the first evaporator 150 is greater than the reference value, it may be determined that an amount of refrigerant is lack. It may then be determined that an amount of refrigerant flowing into the second evaporator 160 is relatively large.

The refrigerant concentration phenomenon may be determined by using the inlet/outlet temperature difference of the second evaporator 160. If the inlet/outlet temperature difference of the first evaporator 150 is equal to the preset reference value (a reference temperature), the refrigerant concentration into the first or second evaporator 150 or 160 may not occur. If the inlet/outlet temperature difference of the first evaporator 150 is not equal to the preset reference value or is greater or less than the reference value, the refrigerant concentration phenomenon into the first or second evaporator 150 or 160 may occur. If the inlet/outlet temperature difference of the first evaporator 150 is less than the preset reference value, it may be determined that a relatively large amount of refrigerant may pass through the first evaporator 150. It may be determined that the refrigerant concentration into the first evaporator 150 occurs.

If the inlet/outlet temperature difference of the first evaporator 150 is greater than the preset reference value, a relatively small amount of refrigerant may pass through the first evaporator 150. It may be determined that the refrigerant concentration into the second evaporator 160 occurs.

As another example of the determination method, the refrigerant may be concentrated into one evaporator 150 or 160 according to whether the inlet/outlet temperature difference of the first evaporator 150 is equal to, greater than, or less than the first set value. For example, the first set value may be 1. When a ratio of the inlet/outlet temperature difference of the first evaporator 150 to the inlet/outlet temperature difference of the second evaporator 160 is 1, i.e., the inlet/outlet temperature differences of the first and second evaporators 150 and 160 are the same, the refrigerant concentration phenomenon may not occur in the first or second evaporator 150 or 160.

When a ratio of the inlet/outlet temperature difference of the first evaporator 150 to the inlet/outlet temperature difference of the second evaporator 160 is greater than 1, i.e., the inlet/outlet temperature difference of the first evaporator 150 is greater than that of the second evaporator 160, the refrigerant concentration phenomenon may not occur in the second evaporator 160. When a ratio of the inlet/outlet temperature difference of the first evaporator 150 to the inlet/outlet temperature difference of the second evaporator 160 is less than 1, i.e., the inlet/outlet temperature difference of the first evaporator 150 is less than that of the second evaporator 160, the refrigerant concentration phenomenon may not occur in the first evaporator 150.

As another example of the determination method, the refrigerant may be concentrated into one evaporator 150 or 160 according to whether a difference value between the inlet/outlet temperature difference of the first evaporator 150 and the inlet/outlet temperature difference of the second evaporator 160 is equal to a second set value, or is greater or less than the second set value. For example, the second set value may be 0. When a value obtained by subtracting the inlet/outlet temperature difference of the second evaporator 160 from the inlet/outlet temperature difference of the first evaporator 150 is 0, i.e., the inlet/outlet temperature differences of the first and second evaporators 150 and 160 are the same, the refrigerant concentration phenomenon may not occur in the first or second evaporator 150 or 160.

When a ratio of the inlet/outlet temperature difference of the first evaporator 150 to the inlet/outlet temperature difference of the second evaporator 160 is greater than 1, i.e., the inlet/outlet temperature difference of the first evaporator 150 is greater than that of the second evaporator 160, the refrigerant concentration phenomenon may not occur in the second evaporator 160. When a ratio of the inlet/outlet temperature difference of the first evaporator 150 to the inlet/outlet temperature difference of the second evaporator 160 is less than 0, i.e., the inlet/outlet temperature difference of the first evaporator 150 is less than that of the second evaporator 160, the refrigerant concentration phenomenon may not occur in the first evaporator 150.

If the refrigerant concentration phenomenon into the first or second evaporator 150 and 160 does not occur through one of the three above-described determination methods, the control state of the flow adjustment unit 130 may be maintained. That is, the flow adjustment unit 130 may be controlled to open all of the first to third refrigerant passages 101, 103, and 105 (S67). If the refrigerant concentration phenomenon occurs in the first or second evaporator 150 or 160, the control state of the flow adjusting part 130 may be changed (S71).

If the refrigerant concentration phenomenon occurs in the first evaporator 150, the third refrigerant passage 105 may be closed to control a flow of the refrigerant through the first and second refrigerant passages 101 and 103. The first refrigerant passage 101 may be closed to control a flow of the refrigerant through the second and third refrigerant passages 103 and 105. An amount of refrigerant introduced into the first evaporator 150 may be decreased, and an amount of refrigerant introduced into the second evaporator 160 may be increased to solve the refrigerant concentration phenomenon in the first evaporator 150 (S72, S73, and S74).

If the refrigerant concentration phenomenon occurs in the second evaporator 160, the opened states of the first to third refrigerant passages 101, 103, and 105 may be maintained. As a time is elapsed, since a relatively large amount of refrigerant circulated into the refrigeration cycle is introduced into the first evaporator 150, the refrigerant concentration phenomenon into the second evaporator 160 may be solved (S76 and S77). When the refrigerant concentration phenomenon occurs in the first or second evaporator 150 or 160, the opening of the first to third refrigerant passages may be controlled to solve the refrigerant concentration phenomenon, and the simultaneous cooling operation of the refrigerating compartment and the freezing compartment may be maintained (S75).

If the refrigerant concentration phenomenon occurs in the second evaporator 160 while the refrigerant flows through the first and second refrigerant passages 101 and 103 by the control method illustrated in operations S73 and S74, the third refrigerant passage 105 may be opened again to control a flow of the refrigerant through the first to third refrigerant passages 101, 103, and 105. Since the flow of the refrigerant into the first evaporator 150 is relatively increased by the above-described control, the refrigerant concentration phenomenon into the second evaporator 160 may be solved. Since the plurality of refrigerant passages 101 and 105 and expansion devices 141 and 145 are provided at an inlet side of the first evaporator 150, and the flow of the refrigerant is controlled according to the excess or leakage of the refrigerant introduced into the first and second evaporators 150 and 160, the refrigerant concentration phenomenon into one evaporator may be prevented while the plurality of evaporators operate at the same time.

According to the proposed embodiments, the exclusive cooling operation of the freezing compartment, the exclusive cooling operation of the refrigerating compartment, or the simultaneous cooling operation of the refrigerating compartment and the freezing compartment may be performed according to the temperature range of the refrigerating compartment and the freezing compartment to optimally control the temperatures of the refrigerating compartment and the freezing compartment. When the refrigerator is turned on to operate, the temperatures of the refrigerating compartment and the freezing compartment may be controlled to reach the lower limit temperature in the range, in which the temperatures of the refrigerating compartment and the freezing compartment are satisfied, at least one time. Thus, the low pressure of the refrigeration cycle may satisfy the target low pressure, and even though the temperatures are increased due to the selective cooling operation of each of the storage compartments, the temperatures of the storage compartments may be defined within the satisfaction range.

Since the simultaneous operation or the alternate operation is selected according to the temperature value of the space (hereinafter, referred to as an installation space of indoor space) in which the refrigerator is installed, the operation efficiency of the refrigerator may be improved, and the power consumption may be reduced. Particularly, when the temperature of the installation space is in the set temperature range, the selective operation (or the alternate operation) of the freezing compartment or the refrigerating compartment may be performed to reduce the power consumption.

The output of the compressor, or the cooling force, may be defined in the set range under the normal operation condition to prevent the excessive power consumption from occurring. On the other hand, the output of the compressor, i.e., the cooling force may be above the set level under the load corresponding condition to improve the cooling performance of the storage compartments. Since a flow rate of the refrigerant introduced into the evaporator is determined on the basis of the inlet/outlet temperatures of the evaporator, and the flow adjustment unit is controlled according to the excess or leakage of the refrigerant, the refrigerant may be effectively distributed into the plurality of evaporators. As a result, refrigerant may be prevented from being concentrated into one evaporator of the plurality of evaporators.

In one embodiment, a method for controlling a refrigerator including a plurality of compressors and a plurality of evaporators provided on inlet-sides of the plurality of compressors to supply cool air to a refrigerating compartment and a freezing compartment may include: determining whether a temperature of the refrigerating compartment is within a refrigerating compartment satisfaction range; determining an indoor temperature when the temperature of the refrigerating compartment is outside of the refrigerating compartment satisfaction range; and determining whether a load corresponding operation condition is satisfied when the determined indoor temperature is within a set range, wherein, when the load corresponding operation condition is satisfied, a simultaneous operation of the refrigerating compartment and the freezing compartment may be performed, and when the load corresponding operation condition is not satisfied, a cooling operation of the refrigerating compartment may be performed. When the determined indoor temperature is above the set range, the simultaneous operation of the refrigerating compartment and the freezing compartment may be performed.

The method may further include: determining whether a temperature of the freezing compartment is within a freezing compartment satisfaction range when the temperature of the refrigerating compartment belongs to the refrigerating compartment satisfaction range; and selectively performing a first refrigerant collection operation when the temperature of the freezing compartment is within the freezing compartment satisfaction range. When the temperature of the freezing compartment is within the freezing compartment satisfaction range, and the former operation state includes a freezing compartment cooling operation, the first refrigerant collection operation may be performed for a first set time.

The method may further include determining whether the temperature of the refrigerating compartment reaches a lower limit temperature in the refrigerating compartment satisfaction range at least one time when the temperature of the freezing compartment is outside of the freezing compartment satisfaction range. The method may further include selectively performing a second refrigerant collection operation when the temperature of the refrigerating compartment reaches the lower limit temperature in the refrigerating compartment satisfaction range at least one time. When the temperature of the refrigerating compartment reaches the lower limit temperature in the refrigerating compartment satisfaction range at least one time, and the former operation state includes the refrigerating compartment cooling operation, the second refrigerant collection operation may be performed for a second set time.

The method may further include performing the freezing compartment cooling operation when the second set time is elapsed. The load corresponding operation condition may include a state in which a temperature of one storage compartment of the refrigerating compartment and the freezing compartment is within an upper limit range, and a temperature of the other storage compartment does not reach the lower limit temperature in the satisfaction range.

The satisfaction range, a dissatisfaction range, and the upper limit range may be defined according to set temperatures, the satisfaction range may include a temperature range that is vertically defined by a first set width according to the set temperature, the dissatisfaction range may include a temperature range that is above a second set width greater than the first set width according to the set temperature, and the upper limit range may include a temperature range that is above the dissatisfaction range. When the simultaneous operation is performed, the plurality of compressors may operate in a first mode to output set cooling force. When the plurality of compressors operate in the first mode for a set time or more, the plurality of compressors may be switched into a second mode to output cooling force greater than the set cooling force.

While the plurality of compressors operate in the first mode or the second mode, when the temperature of the refrigerating compartment is within the refrigerating compartment satisfaction range, or the temperature of the freezing compartment is within the freezing compartment satisfaction range, an exclusive cooling operation of the refrigerating compartment or the freezing compartment may be performed.

A method for controlling a refrigerator may include: performing an exclusive cooling operation of a refrigerating compartment or a freezing compartment; determining whether a temperature of one storage compartment of the refrigerating compartment and the freezing compartment is within an upper limit range; determining whether a temperature of the other storage compartment of the refrigerating compartment and the freezing compartment reaches a lower limit temperature when the one storage compartment of the refrigerating compartment and the freezing compartment is within the upper limit range; and performing a simultaneous operation of the refrigerating compartment and the freezing compartment when the other storage compartment of the refrigerating compartment and the freezing compartment reaches the lower limit temperature.

While the simultaneous cooling operation of the refrigerating compartment and the freezing compartment is performed, a compressor may operate a normal mode for a set time to output set cooling force. When the set time is elapsed, the compressor may be switched into a power mode to output a cooling force greater than the set cooling force. The operation of the compressor in the power mode may be maintained until the temperature of the refrigerating compartment and the freezing compartment reaches the satisfaction range. The upper limit range may include a temperature range having a temperature value greater than that of the satisfaction range.

A refrigerator may include: first and second compressors that compress a refrigerant; a condenser that condenses the refrigerant that is compressed in the first and second compressor; a flow adjustment valve branching the refrigerant condensed in the condenser into three evaporation passages; a first evaporator connected to two evaporation passages of the three evaporation passages to generate cool air to be supplied into the refrigerating compartment; a second evaporator connected to one evaporation passage of the three evaporation passages to generate cool air to be supplied into the freezing compartment; a storage compartment temperature sensor that detects temperatures of the refrigerating compartment and the freezing compartment; an indoor temperature sensor that detects an indoor temperature; and a controller that controls the flow adjustment valve to adjust the supply of the cool air into the refrigerating compartment or the freezing compartment on the basis of the temperature values detected by the storage compartment temperature sensor and the indoor temperature sensor, wherein the controller determines whether the temperatures of the refrigerating compartment and the freezing compartment are within a dissatisfaction range or an upper limit range, and when the indoor temperature belongs to a set range, an exclusive cooling operation of the refrigerating compartment is performed, and when the indoor temperature is outside of the set range, a simultaneous operation of the refrigerating compartment and the freezing compartment is performed.

The satisfaction range may include a temperature range that is vertically defined by a first set width according to the set temperature, the dissatisfaction range may include a temperature range that is above a second set width greater than the first set width according to the set temperature, and the upper limit range may include a temperature range that is above the dissatisfaction range. When the temperature of the freezing compartment is within the upper limit range or the dissatisfaction range, and the temperature of the refrigerating compartment is within the satisfaction range, the controller may determine whether the temperature of the refrigerating compartment reaches a lower limit temperature in the satisfaction range.

When it is determined that the temperature of the refrigerating compartment reaches the lower limit temperature in the satisfaction range, the controller may perform a cooling operation of the freezing compartment. When it is determined that the temperature of the refrigerating compartment does not reach the lower limit temperature in the satisfaction range in a state in which the temperature of the freezing compartment is within the dissatisfaction range, the controller may perform a cooling operation of the refrigerating compartment or a simultaneous operation of the refrigerating compartment and the freezing compartment according to the indoor temperature.

When it is determined that the supply of the refrigerant is concentrated into the first evaporator, the controller may control the flow adjustment valve so that one of the two evaporation passages is closed.

When it is determined that the supply of the refrigerant is concentrated into the second evaporator, the controller may control the flow adjustment valve so that all the three evaporation passages are opened.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

What is claimed is:

1. A method for controlling a refrigerator including a plurality of compressors and a plurality of evaporators provided on inlet-sides of the plurality of compressors to supply cool air to a compartment of the refrigerator which includes a refrigerating compartment and a freezing compartment, wherein a satisfaction range, a dissatisfaction range, and an upper limit range of the refrigerating compartment and the freezing compartment are defined with respect to a predetermined temperature, the satisfaction range includes a temperature range that is defined by a first set difference with respect to the predetermined temperature, the dissatisfaction range includes a temperature range that is above the satisfaction range and defined by a second set difference greater than the first set difference with respect to the predetermined temperature, and the upper limit range includes a temperature range that is above the dissatisfaction range, the method comprising:

determining whether a temperature of the refrigerating compartment is within the satisfaction range of the refrigerating compartment that includes the predetermined temperature set by a user;

determining an indoor temperature when the temperature of the refrigerating compartment is outside of the satisfaction range of the refrigerating compartment;

determining whether a load corresponding operation condition is satisfied, wherein a temperature of one storage compartment is significantly increased while a temperature of the other storage compartment satisfies a specific condition, when the determined indoor temperature is within a set range, wherein, when the load corresponding operation condition is satisfied, a simultaneous cooling operation of the refrigerating compartment and the freezing compartment is performed, and when the load corresponding operation condition is not satisfied, a cooling operation of the refrigerating compartment is performed;

determining whether a temperature of the freezing compartment is within the satisfaction range of the freezing compartment when the temperature of the refrigerating compartment is within the satisfaction range of the refigerating compartment;

performing a first refrigerant collection operation when the temperature of the freezing compartment is within the satisfaction range of the freezing compartment;

determining whether a first satisfaction state in which the temperature of the refrigerating compartment reaches a lower limit temperature in the satisfaction range of the refrigerating compartment at least one time is satisfied when the temperature of the freezing compartment is outside of the satisfaction range of the freezing compartment; and performing a second refrigerant collection operation when the first satisfaction state is satisfied.

2. The method according to claim 1, wherein when the determined indoor temperature is above the set range, the simultaneous operation of the refrigerating compartment and the freezing compartment is performed.

3. The method according to claim 1, wherein when the temperature of the freezing compartment is within the freezing compartment satisfaction range, and a former operation state includes a freezing compartment cooling operation, the first refrigerant collection operation is performed for a first set time.

4. The method according to claim 1, wherein when the temperature of the refrigerating compartment reaches the lower limit temperature in the refrigerating compartment satisfaction range at least one time, and the former operation state includes the refrigerating compartment cooling operation, the second refrigerant collection operation is performed for a second set time.

5. The method according to claim 4, further including performing the freezing compartment cooling operation when the second set time is elapsed.

6. The method according to claim 1, wherein the load corresponding operation condition includes a state in which a temperature of one storage compartment of the refrigerating compartment and the freezing compartment is within an upper limit range, and a temperature of the other storage compartment does not reach the lower limit temperature in the satisfaction range.

7. The method according to claim 6, wherein the satisfaction range, a dissatisfaction range, and the upper limit range are defined with respect to a set temperature, the satisfaction range includes a temperature range that is vertically defined by a first set width with respect to the set temperature, the dissatisfaction range includes a temperature range that is above a second set width greater than the first set width with respect to the set temperature, and the upper limit range includes a temperature range that is above the dissatisfaction range.

8. The method according to claim 1, wherein when the simultaneous operation is performed, the plurality of compressors operate in a first mode to output a set cooling force.

9. The method according to claim 8, wherein when the plurality of compressors operate in the first mode for at least a set time, the plurality of compressors are switched into a second mode to output a cooling force greater than the set cooling force.

10. The method according to claim 9, wherein while the plurality of compressors operate in the first mode or the second mode, when the temperature of the refrigerating compartment is within the refrigerating compartment satisfaction range, or the temperature of the freezing compartment is within the freezing compartment satisfaction range, an exclusive cooling operation of either the refrigerating compartment or the freezing compartment is performed.

11. A method for controlling a refrigerator, wherein a satisfaction range, a dissatisfaction range and an upper limit range of the refrigerating compartment and the freezing compartment are defined with respect to a predetermined temperature, the satisfaction range includes a temperature range that is defined by a first set difference with respect to the predetermined temperature, the dissatisfaction range includes a temperature range that is above the satisfaction range and defined by a second set difference greater than the first set difference with respect to the predetermined temperature, and the upper limit range includes a temperature range that is above the dissatisfaction range, the method comprising:

performing an exclusive cooling operation of either a refrigerating compartment or a freezing compartment;

determining whether a temperature of one storage compartment of the refrigerating compartment and the freezing compartment is within an upper limit range;

determining a temperature of the other storage compartment of the refrigerating compartment and the freezing compartment is within the satisfaction range when the one storage compartment of the refrigerating compartment and the freezing compartment is within the upper limit range;

determining whether a first satisfaction state in which a temperature of the other storage compartment of the refrigerating compartment and the freezing compartment reaches a lower limit temperature in the satisfaction range at least one time is satisfied when the other storage compartment of the refrigerating compartment and the freezing compartment is within the satisfaction range; and performing the exclusive cooling operation of either the refrigerating compartment or the freezing compartment when the first satisfaction state is satisfied, and performing a simultaneous cooling operation of the refrigerating compartment and the freezing compartment when a first dissatisfaction state in which a temperature of the other storage compartment of the refrigerating compartment and the freezing compartment does not reach the lower limit temperature in the satisfaction range at all is satisfied.

12. The method according to claim 11, wherein while the simultaneous operation of the refrigerating compartment and the freezing compartment is performed, a compressor operates a normal mode for a set time to output set cooling force.

13. The method according to claim 12, wherein when the set time is elapsed, the compressor is switched into a power mode to output a cooling force greater than the set cooling force.

14. The method according to claim 13, wherein the operation of the compressor in the power mode is maintained until the temperatures of the refrigerating compartment and the freezing compartment reach the satisfaction range.

15. The method according to claim 1, wherein the first refrigerant collection operation includes collecting refrigerant in a condenser and restricting a flow of the refrigerant into the plurality of evaporators for a first predetermined time, and the second refrigerant collection operation includes collecting refrigerant in the condenser and restricting the flow of the refrigerant into the plurality of evaporators for a second predetermined time, the first predetermined time being different from the second predetermined time.

* * * * *